US010268140B2

(12) United States Patent
Eto et al.

(10) Patent No.: US 10,268,140 B2
(45) Date of Patent: Apr. 23, 2019

(54) DEVELOPER STORAGE CONTAINER AND IMAGE FORMING APPARATUS INCLUDING THE SAME

(71) Applicant: KYOCERA Document Solutions Inc., Osaka-shi (JP)

(72) Inventors: Daisuke Eto, Osaka (JP); Riku Minamoto, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/019,594

(22) Filed: Jun. 27, 2018

(65) Prior Publication Data

US 2019/0011856 A1 Jan. 10, 2019

(30) Foreign Application Priority Data

Jul. 7, 2017 (JP) ..... 2017-133824

(51) Int. Cl.
*G03G 15/08* (2006.01)
*G03G 15/20* (2006.01)
*G03G 15/16* (2006.01)

(52) U.S. Cl.
CPC ..... *G03G 15/0887* (2013.01); *G03G 15/0867* (2013.01); *G03G 15/0893* (2013.01); *G03G 15/161* (2013.01); *G03G 15/2028* (2013.01); *G03G 15/2064* (2013.01)

(58) Field of Classification Search
CPC ..... G03G 15/0867; G03G 15/0887; G03G 15/161; G03G 15/2028; G03G 15/2064
See application file for complete search history.

(56) References Cited

U.S. PATENT DOCUMENTS 5,084,734 A * 1/1992 Yoshino ..... G03G 21/12 222/DIG. 1
2015/0185661 A1 7/2015 Eto
2015/0277290 A1* 10/2015 Eto ..... G03G 15/0877 399/254

FOREIGN PATENT DOCUMENTS

JP 2015-125333 7/2015

* cited by examiner

*Primary Examiner* — Gregory H Curran
(74) *Attorney, Agent, or Firm* — Gerald E. Hespos; Michael J. Porco; Matthew T. Hespos

(57) ABSTRACT

A developer storage container includes a container body, a shaft, a moving wall and a pressing member. The container body has an inner peripheral surface defining a tubular internal space extending along a first direction. The shaft is arranged to extend in the first direction in the internal space and rotatably supported. The moving wall is movable in the first direction in the internal space while conveying the developer in the internal space toward a developer discharge port. The pressing member moves integrally with the moving wall by pressing the moving wall when the shaft is rotated in a first rotating direction and relatively moves to an upstream side with respect to the moving wall according to the engagement of a first engaging portion and a second engaging portion when the shaft is rotated in a second rotating direction opposite to the first rotating direction.

9 Claims, 38 Drawing Sheets

DEVELOPER STORAGE CONTAINER AND IMAGE FORMING APPARATUS INCLUDING THE SAME

This application is based on Japanese Patent Application No. 2017-133824 filed with the Japan Patent Office on Jul. 7, 2017, the contents of which are hereby incorporated by reference.

BACKGROUND

The present disclosure relates to a developer storage container for storing a developer and an image forming apparatus provided with the same.

Conventionally, a developer storage container provided in an image forming apparatus is known as the one for storing a developer. The image forming apparatus includes an image carrier, a developing device and the developer storage container. When the developer is supplied from the developing device to the image carrier, an electrostatic latent image formed on the image carrier is developed as a developer image. The developer storage container includes a developer discharge port and supplies a replenishing developer to a replenishing port provided in the developing device.

Further, a developer storage container is known which includes a moving wall configured to move along a shaft while conveying a developer toward a developer discharge port. In this technique, the moving wall moves according to the rotation of the shaft by the engagement of an externally threaded portion provided on the outer peripheral surface of the shaft and an internally threaded portion provided in a bearing portion of the moving wall.

SUMMARY

A developer storage container according to one aspect of the present disclosure includes a container body, a shaft, a moving wall and a pressing member. The container body has an inner peripheral surface defining a tubular internal space extending along a first direction. The container body is formed with a developer discharge port open to communicate with the internal space and allowing a developer to be discharged. The shaft is arranged to extend in the first direction in the internal space and rotatably supported in the container body. The shaft includes a first engaging portion spirally formed along the first direction on an outer peripheral surface. The moving wall includes a first bearing portion, the shaft being inserted through the first bearing portion, an outer peripheral surface arranged in contact with the inner peripheral surface of the container body and a conveying surface defining a storage space for storing the developer together with the inner peripheral surface of the container body. The moving wall is movable in the first direction along the shaft in the internal space while conveying the developer in the internal space toward the developer discharge port. The pressing member is arranged upstream of the moving wall in the first direction. The pressing member includes a second bearing portion, the shaft being inserted through the second bearing portion, a second engaging portion arranged on an inner peripheral surface of the second bearing portion and engageable with the first engaging portion, and a pressing portion configured to press the moving wall in the first direction. The pressing member moves in the first direction integrally with the moving wall by the pressing portion pressing the moving wall according to the engagement of the first engaging portion and the second engaging portion when the shaft is rotated in a first rotating direction, and relatively moves to an upstream side in the first direction with respect to the moving wall according to the engagement of the first engaging portion and the second engaging portion when the shaft is rotated in a second rotating direction opposite to the first rotating direction.

An image forming apparatus according to another aspect of the present disclosure includes the above developer storage container, an image carrier, a developing device and a transfer unit. The image carrier is configured such that an electrostatic latent image is formed on a surface and a developer image is carried thereon. The developing device has the developer replenished thereinto from the developer storage container and supplies the developer to the image carrier. The transfer unit transfers the developer image from the image carrier to a sheet.

DETAILED DESCRIPTION

Figure 1:
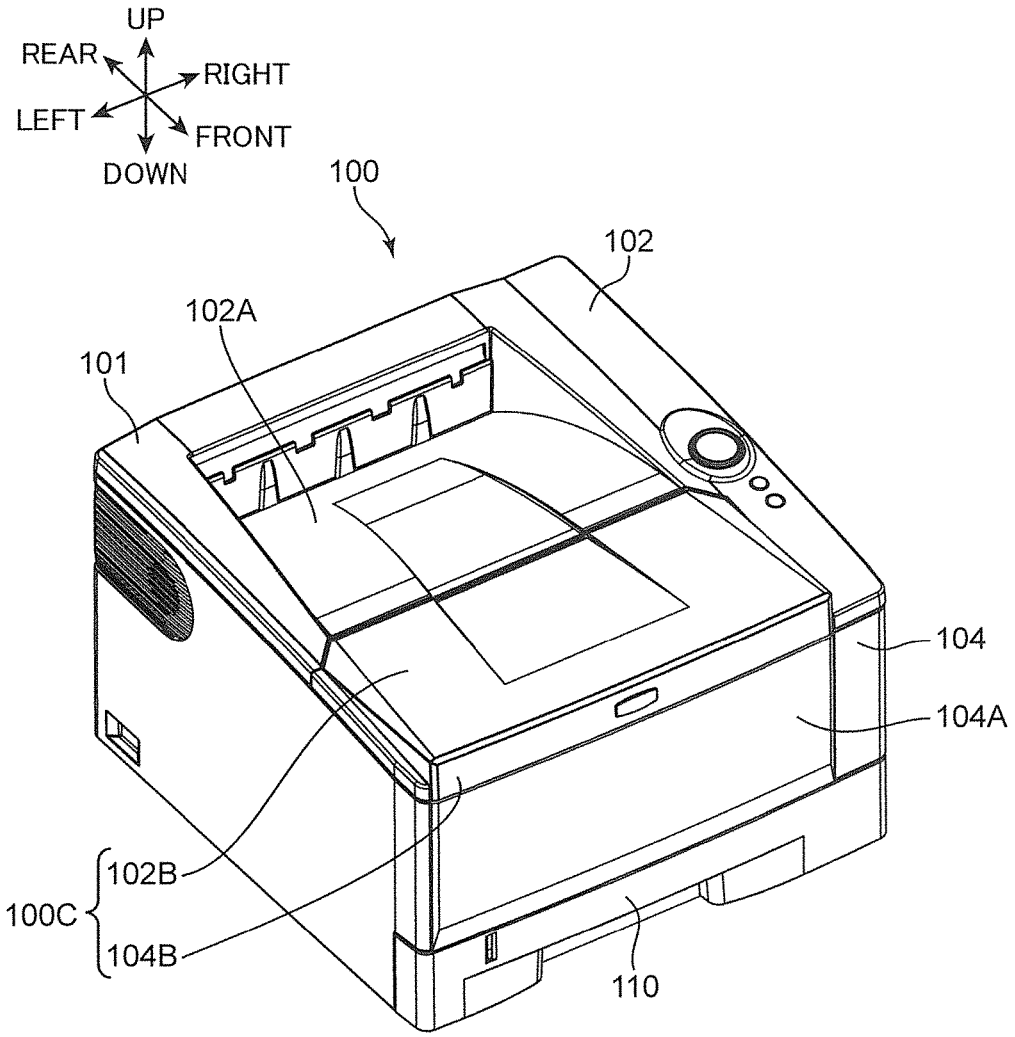
FIG. 1 is a perspective view showing an image forming apparatus according to one embodiment of the present disclosure.
Figure 2:
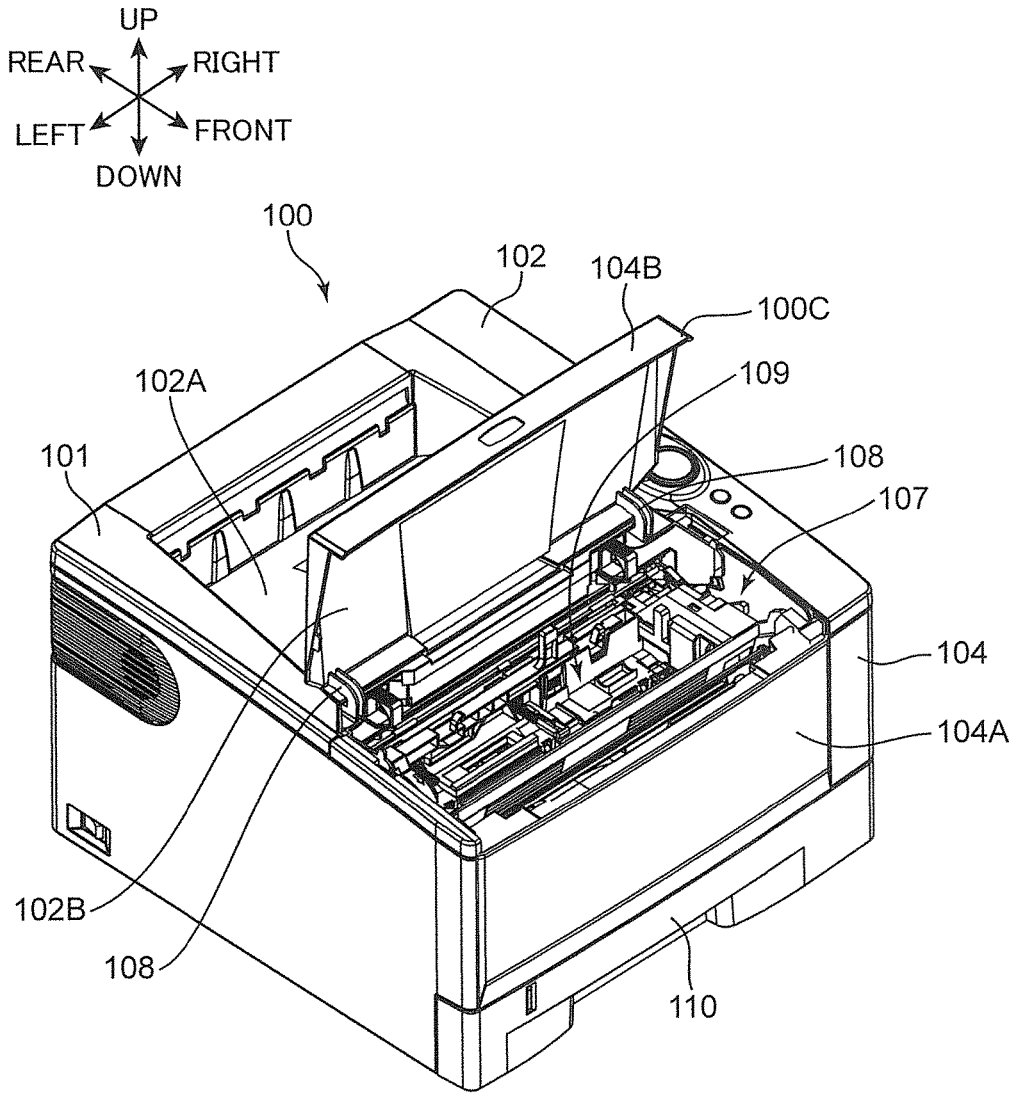
FIG. 2 is a perspective view in a state where a part of a housing of the image forming apparatus according to the embodiment of the present disclosure is opened.
Figure 3:
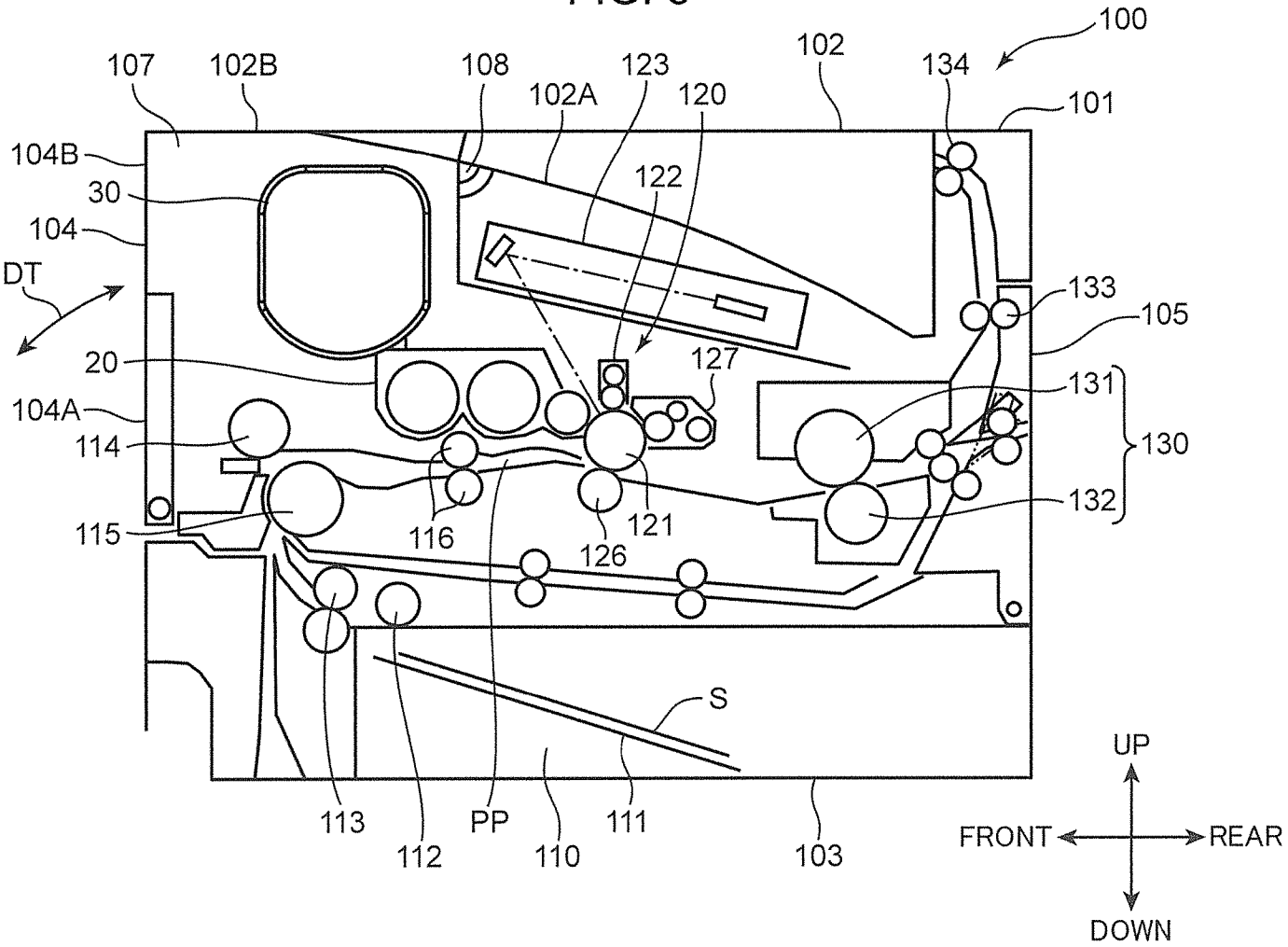
FIG. 3 is a schematic sectional view showing an internal structure of the image forming apparatus according to the embodiment of the present disclosure.

Hereinafter, one embodiment of the present disclosure is described with reference to the drawings. FIGS. 1 and 2 are perspective views of a printer 100 (image forming apparatus) according to the embodiment of the present disclosure. FIG. 3 is a sectional view schematically showing an internal structure of the printer 100 shown in FIGS. 1 and 2. The printer 100 shown in FIGS. 1 to 3 is a so-called monochrome printer. However, in another embodiment, the image forming apparatus may be a color printer, a facsimile machine, a complex machine provided with these functions or another apparatus for forming a toner image on a sheet. Note that direction-indicating terms such as "upper" and "lower", "front" and "rear", "left" and "right" used in the following description are merely for the purpose of clarifying the description and do not limit the principle of the image forming apparatus at all.

The printer 100 includes a housing 101 for housing various devices for forming an image on a sheet S. The housing 101 includes an upper wall 102 defining the upper surface of the housing 101, a bottom wall 103 (FIG. 3) defining the bottom surface of the housing 101, a body rear wall 105 (FIG. 3) between the upper wall 102 and the bottom wall 103 and a body front wall 104 located in front of the body rear wall 105. The housing 101 has a body internal space 107 in which various devices are arranged. A sheet conveyance path PP along which a sheet S is conveyed in a predetermined conveying direction extends in the body internal space 107 of the housing 101. Further, the printer 100 includes an access cover 100C to be openably and closably mounted on the housing 101.

The access cover 100C is composed of a front wall upper part 104B, which is an upper part of the body front wall 104, and an upper wall front part 102B, which is a front part of the upper wall 102. Further, the access cover 100C is openable and closable in a vertical direction with unillustrated hinge shafts arranged on a pair of arm portions 108 arranged on both end parts in a lateral direction as supporting points (FIG. 2). In an open state of the access cover 100C, an upper part of the body internal space 107 is opened to outside. On the other hand, in a closed state of the access cover 100C, the upper part of the body internal space 107 is closed.

A sheet discharge portion 102A is arranged in a central part of the upper wall 102. The sheet discharge portion 102A is formed of an inclined surface inclined downward from a front part to a rear part of the upper wall 102. A sheet S having an image formed thereon in an image forming unit 120 to be described later is discharged to the sheet discharge portion 102A. Further, a manual feed tray 104A is arranged in a vertically central part of the body front wall 104. The manual feed tray 104A is vertically rotatable about a lower end (arrow DT of FIG. 3).

With reference to FIG. 3, the printer 100 includes a cassette 110, a pickup roller 112, a first feed roller 113, a second feed roller 114, a conveyor roller 115, a pair of registration rollers 116, the image forming unit 120 and a fixing device 130.

The cassette 110 stores sheets S inside. The cassette 110 includes a lift plate 111. The lift plate 111 is inclined to push up the leading end edges of the sheets S. The cassette 110 can be pulled out forward with respect to the housing 101.

The pickup roller 112 is arranged above the leading end edges of the sheets S pushed up by the lift plate 111. When the pickup roller 112 rotates, the sheet S is pulled out from the cassette 110.

The first feed roller 113 is disposed downstream of the pickup roller 112 and feeds the sheet S to a further downstream side. The second feed roller 114 is disposed inwardly (rearwardly) of a pivot point of the manual feed tray 104A and pulls a sheet S on the manual feed tray 104A into the housing 101.

The conveyor roller 115 is disposed downstream of the first feed roller 113 and the second feed roller 114 in a sheet conveying direction. The conveyor roller 115 conveys the sheet S fed by the first and second feed rollers 113, 114 to a further downstream side.

The pair of registration rollers 116 function to correct the oblique feed of the sheet S. In this way, the position of an image to be formed on the sheet S is adjusted. The pair of registration rollers 116 feed the sheet S to the image forming unit 120 in accordance with an image formation timing by the image forming unit 120.

The image forming unit 120 includes a photoconductive drum 121 (image carrier), a charger 122, an exposure device 123, a developing device 20, a toner container 30 (developer storage container), a transfer roller 126 (transfer unit) and a cleaning device 127.

The photoconductive drum 121 has a cylindrical shape. The photoconductive drum 121 has a surface, on which an electrostatic latent image is to be formed, and carries a toner image (developer image) corresponding to the electrostatic latent image on the surface. The charger 122 has a predetermined voltage applied thereto and substantially uniformly charges the peripheral surface of the photoconductive drum 121.

The exposure device 123 irradiates laser light to the peripheral surface of the photoconductive drum 121 charged by the charger 122. As a result, an electrostatic latent image corresponding to image data is formed on the peripheral surface of the photoconductive drum 121.

The developing device 20 supplies toner to the peripheral surface of the photoconductive drum 121 having an electrostatic latent image formed thereon. The toner container 30 supplies the toner (replenishing developer) to the developing device 20. The toner container 30 is disposed to be detachably attachable to the developing device 20. When the developing device 20 supplies the toner to the photoconductive drum 121, an electrostatic latent image formed on the peripheral surface of the photoconductive drum 121 is developed (visualized). As a result, a toner image (developer image) is formed on the peripheral surface of the photoconductive drum 121.

The transfer roller 126 is arranged below the photoconductive drum 121 to face the photoconductive drum 121 across the sheet conveyance path PP. A transfer nip portion is formed between the transfer roller 126 and the photoconductive drum 121, and the transfer roller 126 transfers the toner image to the sheet S.

The cleaning device 127 removes the toner remaining on the peripheral surface of the photoconductive drum 121 after the toner image is transferred to the sheet S.

The fixing device 130 is arranged downstream of the image forming unit 120 in the conveying direction and fixes the toner image on the sheet S. The fixing device 130 includes a heating roller 131 for melting the toner on the sheet S and a pressure roller 132 for bringing the sheet S into close contact with the heating roller 131.

The printer 100 further includes a pair of conveyor rollers 133 disposed downstream of the fixing device 130 and a pair of discharge rollers 134 disposed downstream of the pair of conveyor rollers 133. The sheet S is conveyed upwardly by the pair of conveyor rollers 133 and finally discharged from the housing 101 by the pair of discharge rollers 134. The sheet S discharged from the housing 101 is stacked on the sheet discharge portion 102A.

<Concerning Developing Device>

Figure 4:
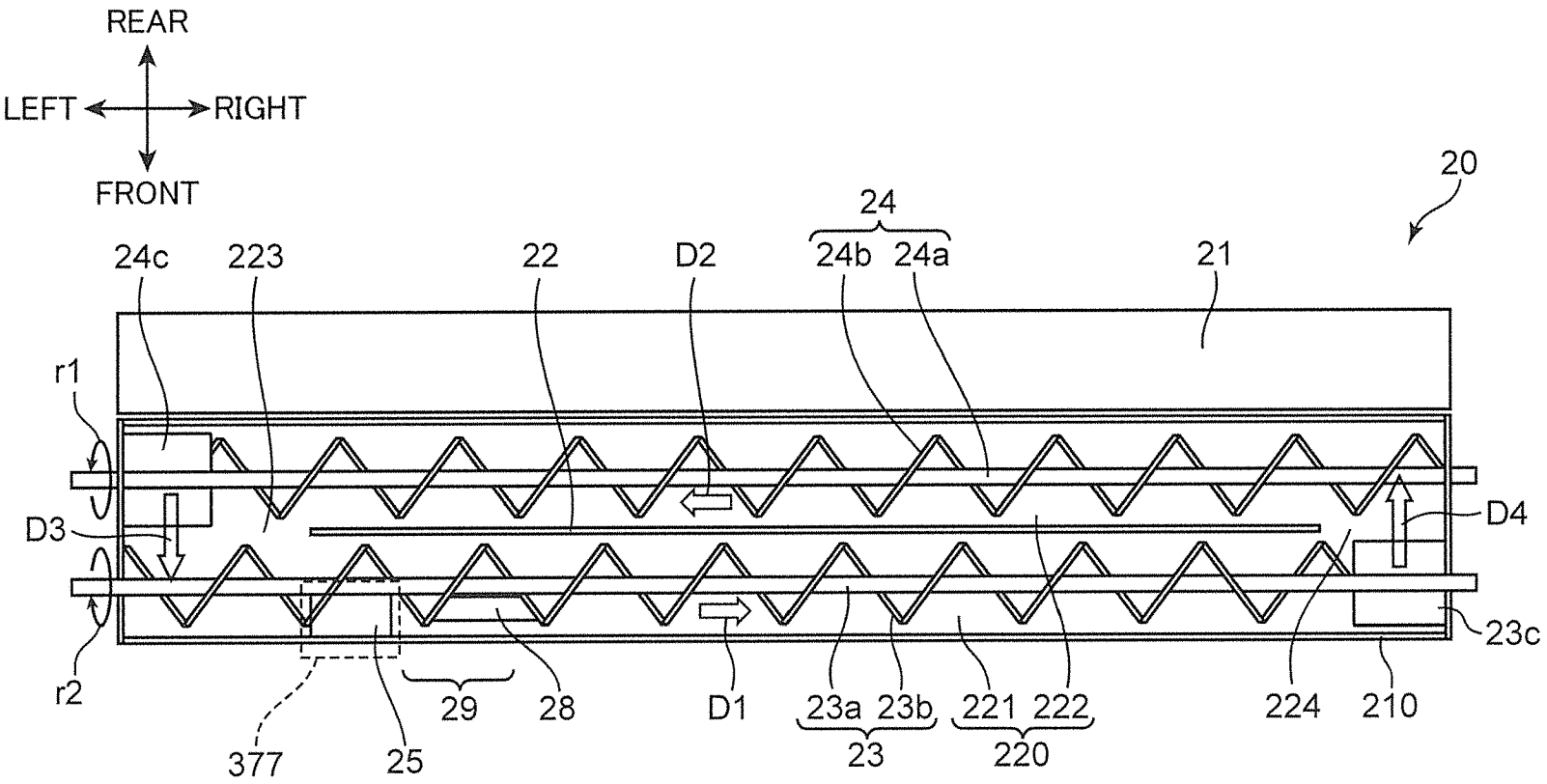
FIG. 4 is a schematic plan view showing an internal structure of a developing device according to the embodiment of the present disclosure.

FIG. 4 is a plan view showing an internal structure of the developing device 20. The developing device 20 includes a development housing 210 (housing) having a box shape long in one direction (axial direction of a developing roller 21, lateral direction). The development housing 210 has a storage space 220 (developer conveyance path). The developing roller 21, a first stirring screw 23 (developer conveying member), a second stirring screw 24 and a toner replenishing port 25 are disposed in the storage space 220. In this embodiment, a one-component development method is applied and a toner is filled as a developer in this storage space 220. On the other hand, in the case of a two-component development method, a mixture of a toner and a carrier made of a magnetic material is filled as a developer. The toner is stirred and conveyed in the storage space 220 and successively supplied from the developing roller 21 to the photoconductive drum 121 to develop an electrostatic latent image.

The developing roller 21 has a cylindrical shape extending in a longitudinal direction of the development housing 210 and includes a sleeve part, which is rotationally driven, on an outer periphery. The storage space 220 of the development housing 210 is covered with an unillustrated top board and partitioned into a first conveyance path 221 and a second conveyance path 222 long in the lateral direction by a partition plate 22 extending in the lateral direction. The partition plate 22 is shorter than a lateral width of the development housing 210, and a first communication path 223 and a second communication path 224 allowing communication between the first and second conveyance paths 221, 222 are provided at left and right ends of the partition plate 22. In this way, a circulation path composed of the first conveyance path 221, the second communication path 224, the second conveyance path 222 and the first communication path 223 is formed in the storage space 220. The toner is conveyed counterclockwise in FIG. 4 in the circulation path.

The toner replenishing port 25 (developer replenishing port) is an opening open in the top board of the development housing 210, and arranged near and above the left end of the first conveyance path 221. The toner replenishing port 25 is arranged to face the above circulation path and has a function of receiving a replenishing toner (replenishing developer) supplied through a toner discharge port 377 (FIG. 4) of the toner container 30 into the storage space 220.

The first stirring screw 23 is disposed in the first conveyance path 221. The first stirring screw 23 includes a first rotary shaft 23*a* and a first spiral blade 23*b* spirally projecting on the periphery of the first rotary shaft 23*a*. The first stirring screw 23 conveys the toner in a direction of an arrow D1 of FIG. 4 by being rotationally driven about the first rotary shaft 23*a* (arrow r2). The first stirring screw 23 conveys the toner through a position where the toner replenishing port 25 faces the first conveyance path 221. In this way, the first stirring screw 23 has a function of conveying a new toner flowing in through the toner replenishing port 25 and the toner conveyed into the first conveyance path 221 from the second conveyance path 222 while mixing these toners. A first paddle 23*c* is disposed downstream of the first stirring screw 23 in a toner conveying direction (direction D1). The first paddle 23*c* is rotated together with the first rotary shaft 23*a* and transfers the toner from the first conveyance path 221 to the second conveyance path 222 in a direction of an arrow D4 of FIG. 4.

The second stirring screw 24 is disposed in the second conveyance path 222. The second stirring screw 24 includes a second rotary shaft 24*a* and a second spiral blade 24*b* spirally projecting on the periphery of the second rotary shaft 24*a*. The second stirring screw 24 supplies the toner to the developing roller 21 while conveying the toner in a direction of an arrow D2 of FIG. 4 by being rotationally driven about the second rotary shaft 24*a* (arrow r1). A second paddle 24*c* is disposed downstream of the second stirring screw 24 in a toner conveying direction (direction D2). The second paddle 24*c* is rotated together with the second rotary shaft 24*a* and transfers the toner from the second conveyance path 222 to the first conveyance path 221 in a direction of an arrow D3 of FIG. 4.

The toner container 30 (FIG. 3) is arranged above the toner replenishing port 25 of the development housing 210. The toner container 30 includes the toner discharge port 377 (FIG. 4). The toner discharge port 377 is disposed in a bottom part of the toner container 30 to correspond to the toner replenishing port 25 of the developing device 20. The toner falling from the toner discharge port 377 is replenished into the developing device 20 through the toner replenishing port 25.

<Concerning Toner Replenishment>

Figure 5:
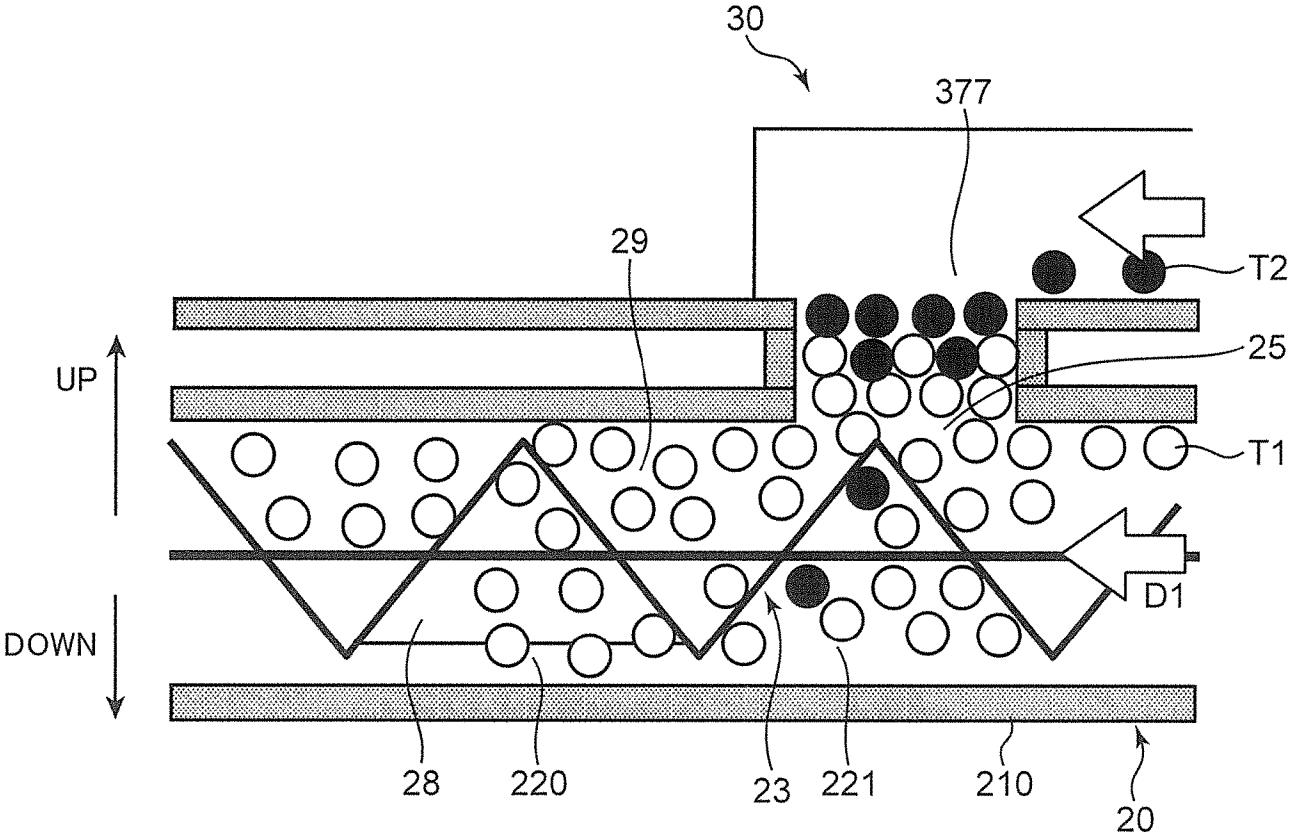
FIG. 5 is a schematic sectional view showing a state where a developer is replenished into the developing device according to the embodiment of the present disclosure.

Next, the flow of toner particles newly replenished through the toner replenishing port 25 is described. FIG. 5 is a sectional view near the toner replenishing port 25 disposed in the developing device 20 and the toner discharge port 377 disposed in the toner container 30.

Replenishing toner particles T2 supplied through the toner discharge port 377 of the toner container 30 fall into the first conveyance path 221 and are mixed with existing toner particles T1 and conveyed in the direction of the arrow D1 by the first stirring screw 23. At this time, the toner particles T1, T2 are stirred to be charged.

The first stirring screw 23 includes, on a side downstream of the toner replenishing port 25 in the toner conveying direction, a suppression paddle 28 (conveying ability suppressing portion) for partially suppressing a toner conveying ability. In this embodiment, the suppression paddle 28 is a plate-like member arranged between adjacent sections of the first spiral blade 23*b* of the first stirring screw 23. By the rotation of the suppression paddle 28 about the first rotary shaft 23*a*, the toner particles conveyed from a side upstream of the suppression paddle 28 start staying. The staying toner particles are accumulated up to a position which is immediately upstream of the suppression paddle 28 and where the toner replenishing port 25 faces the first conveyance path 221. As a result, a staying portion 29 of the toner (developer staying portion) is formed near an inlet of the toner replenishing port 25. Note that the first spiral blade 23*b* is arranged in an area facing the toner replenishing port 25 (FIG. 4). Further, in another embodiment, the conveying ability suppressing portion may be formed by an area where the first spiral blade 23*b* of the first stirring screw 23 is partially missing and the first rotary shaft 23*a* is partially exposed along an axial direction. Also in this configuration, the conveying ability of the first stirring screw 23 is partially suppressed, wherefore the staying portion of the toner is formed.

When the replenishing toner particles T2 are replenished through the toner replenishing port 25 and the amount of the toner particles in the storage space 220 increases, the toner particles staying in the staying portion 29 close (seal) the toner replenishing port 25 to suppress any further replenishment of the toner particles. Further, the first spiral blade 23*b* pushes the toner in the storage space 220 around the toner replenishing port 25 upwardly by being rotated. As a result, an action to seal the toner replenishing port 25 by the staying portion 29 is increased. Thereafter, when the toner particles in the storage space 220 are consumed by the developing roller 21 and the toner particles staying in the staying portion 29 decrease, the toner particles having closed the toner replenishing port 25 decrease to form a clearance between the staying portion 29 and the toner replenishing port 25. As a result, the replenishing toner particles T2 flow into the storage space 220 through the toner replenishing port 25 again. As just described, a volume replenishment type toner replenishing method of adjusting a receiving amount of the replenishing toner particles as the toner particles staying in the staying portion 29 decrease is adopted in this embodiment. Thus, the toner particles can be replenished into the developing device 20 even without providing a sensor for detecting a toner amount in the development housing 210 of the developing device 20.

<Concerning Attachment of Toner Container to Developing Device>

Figure 6:
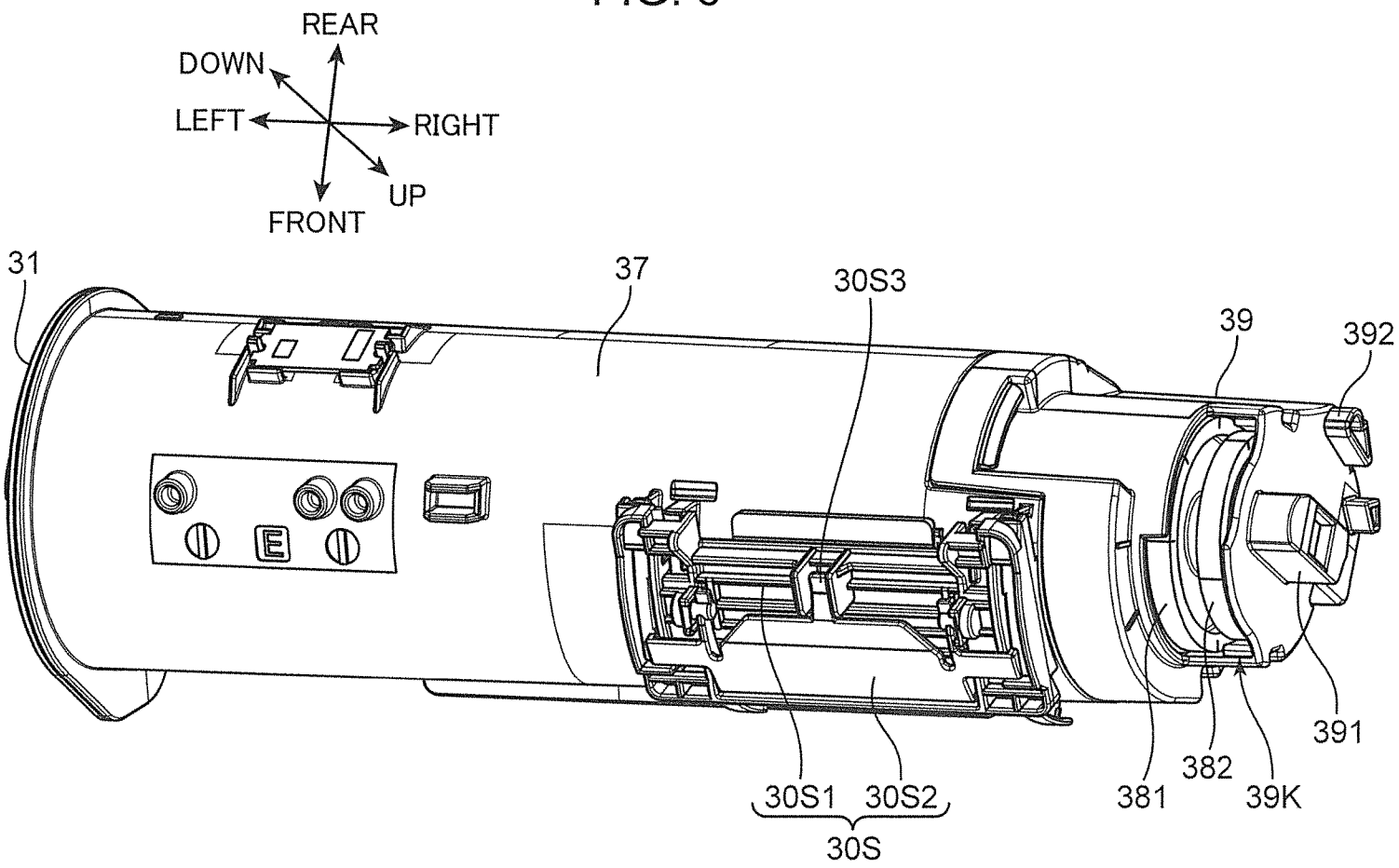
FIG. 6 is a perspective view of a developer storage container according to the embodiment of the present disclosure.
Figure 7:
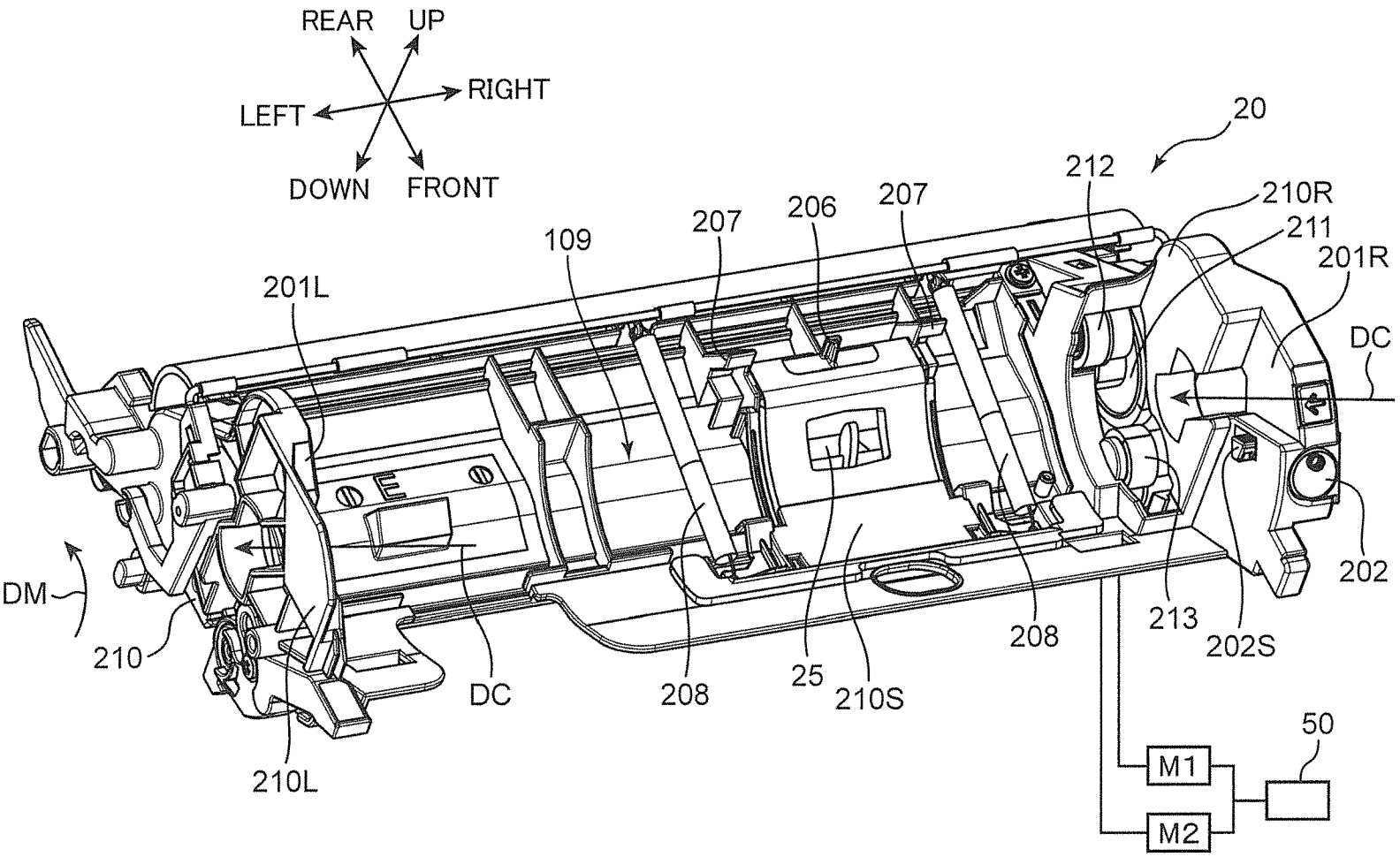
FIG. 7 is a perspective view of the developing device according to the embodiment of the present disclosure.

FIGS. 6 and 7 are respectively perspective views of the toner container 30 and the developing device 20 according to this embodiment. The toner container 30 is attachable to and detachable from the developing device 20 in the housing 101.

The toner container 30 includes a lid portion 31, a container body 37, a cover 39 and a container shutter 30S (FIG. 6).

The container body 37 is a body part of the toner container 30 and stores the toner inside. The lid portion 31 closes a left end part of the container body 37. The cover 39 is attached to a right end part of the container body 37.

The shutter 30S is supported slidably with respect to the container body 37. The container shutter 30S has a function of sealing and opening the toner discharge port 377 of the container body 37. The container shutter 30S includes a shutter body 30S1, a shutter locking portion 30S2 and an unlocking portion 30S3. The shutter body 30S1 is a body part of the container shutter 30S and has a function of sealing and opening the toner discharge port 377. The shutter body 30S1 is supported slidably with respect to the container body 37. The shutter locking portion 30S2 is supported swingably with respect to the shutter body 30S1. The shutter locking portion 30S2 has a function of allowing and restricting a sliding movement of the shutter body 30S1 with respect to the container body 37. The unlocking portion 30S3 is a projecting piece provided on the shutter locking portion 30S2. When the unlocking portion 30S3 is pressed, an unillustrated lock piece provided on the shutter locking portion 30S2 is disengaged from an engaging portion formed on the container body 37 to enable a sliding movement of the shutter body 30S1.

With reference to FIG. 2, when the access cover 100C of the housing 101 is opened upwardly, a container mounting portion 109 provided in the development housing 210 of the developing device 20 is exposed to the outside of the housing 101. With reference to FIG. 7, the development housing 210 includes a pair of a housing left wall 210L and a housing right wall 210R. The container mounting portion 109 is formed between the housing left wall 210L and the housing right wall 210R. In this embodiment, the toner container 30 is obliquely mounted into the container mounting portion 109 from above (see arrow DC of FIG. 7). At this time, the cover 39 of the toner container 30 is arranged on the side of the housing right wall 210R, and the lid portion 31 of the toner container 30 is arranged on the side of the housing left wall 210L. The development housing 210 includes a left guide groove 201L and a right guide groove 201R (FIG. 7).

The left guide groove 201L and the right guide groove 201R are respectively groove portions formed in the housing left wall 201L and the housing right wall 201R. The left and right guide grooves 201L, 201R guide the mounting of the toner container 30 into the container mounting portion 109. Thus, entrance sides of the left and right guide grooves 201L, 201R are formed to extend along a mounting direction (direction of an arrow DC of FIG. 7) of the toner container 30. On the other hand, back sides of the left and right guide grooves 201L, 201R have a fan shape to allow the rotation of a first guide portion 312 (FIG. 8) and a second guide portion 391 (FIG. 6) as described later.

Further, with reference to FIG. 7, the developing device 20 includes a first transmission gear 211, a second transmission gear 212 and a third transmission gear 213. Further, the printer 100 includes a first motor M1, a second motor M2 and a controller 50 provided in the housing 101 (FIG. 7). The first, second and third transmission gears 211, 212 and 213 are gears rotatably supported on the housing right wall 210R. The first transmission gear 211 is coupled to the second transmission gear 212. Further, the first transmission gear 211 is coupled to the developing roller 21, the first stirring screw 23 and the second stirring screw 24 via an unillustrated gear group. When the developing device 20 is mounted into the housing 101, the first motor M1 is coupled to the third transmission gear 213 and the second motor M2 is coupled to the first transmission gear 211.

The first motor M1 moves a later-described moving wall 32 of the toner container 30 by rotating a later-described shaft 33 of the toner container 30 via the third transmission gear 213. Specifically, the third transmission gear 213 is engaged with a later-described second container gear 382 of the toner container 30 to transmit a drive force of the first motor M1 to the second container gear 382. The second motor M2 rotates the developing roller 21, the first stirring screw 23 and the second stirring screw 24 of the developing device 20 via the first transmission gear 211. Further, the second motor M2 rotates a later-described stirring member 35 of the toner container 30 via the first and second transmission gears 211, 212. The controller 50 controls each of the first and second motors M1, M2 to drive the respective members of the developing device 20 and the toner container 30 in a printing operation and the like of the printer 100.

Further, the development housing 210 includes an unlocking button 202, the aforementioned toner replenishing port 25 (developer replenishing port), a releasing projection 206, a pair of container shutter fixing portions 207, a pair of shutter springs 208 (biasing member) and a housing shutter 210S.

The unlocking button 202 is a press button slidably supported on the housing right wall 210R. The unlocking button 202 has a function of locking or unlocking the posture of the toner container 30 mounted in the container mounting portion 109. The unlocking button 202 includes a lock engaging piece 202S. The lock engaging piece 202S is a claw part formed to project toward the container mounting portion 109 on a front part of the housing right wall 210R. Further, the developing device 20 includes an unillustrated lock biasing spring. The lock biasing spring is a coil spring arranged inside the housing right wall 210R to bias the unlocking button 202 forward. The lock engaging piece 202S has a function of locking the posture of the toner container 30 mounted in the container mounting portion 109. On the other hand, when the unlocking button 202 is pressed against a biasing force of the lock biasing spring, the lock engaging piece 202S is separated from the toner container 30 to release the locking function for the toner container 30.

The aforementioned toner replenishing port 25 is an opening having a substantially rectangular shape and open in the top board of the development housing 210 (FIG. 7). The toner replenishing port 25 communicates with the inside of the development housing 210. Further, the toner replenishing port 25 is arranged to face the toner container 30 mounted in the container mounting portion 109. The toner discharged through the toner discharge port 377 of the toner container 30 flows into the development housing 210 through the toner replenishing port 25.

The unlocking projection 206 is a projection provided behind and adjacent to the toner replenishing port 25 and projecting from the top board of the development housing 210. The unlocking projection 206 has a function of pressing the unlocking portion 30S3 (FIG. 6) of the container shutter 30S of the toner container 30 when the toner container 30 is mounted into the container mounting portion 109. In other words, the unlocking projection 206 allows a sliding movement of the container shutter 30S.

The pair of container shutter fixing portions 207 are projections projecting from the top board of the development housing 210 at both sides of the unlocking projection 206 in the lateral direction. In a cross-section intersecting the lateral direction, the container shutter fixing portion 207 has a substantially trapezoidal shape. Further, a front side surface of the container shutter fixing portion 207 is formed with a wedge-shaped notch. When the toner container 30 is mounted into the container mounting portion 109, this notch is engaged with a part of the container shutter 30S of the toner container 30. As a result, the container shutter fixing portions 207 fix the container shutter 30S and restrict a movement (rotation) of the container shutter 30S. Further, the container shutter fixing portions 207 allow the rotation of the container body 37 in a second rotating direction when the toner container 30 is attached.

The pair of shutter springs 208 are a pair of spring members arranged outwardly of the pair of container shutter fixing portions 207 in the lateral direction. The shutter springs 208 are arranged to extend in a front-rear direction. Rear end parts of the pair of shutter springs 208 are respectively locked to the top board of the development housing 210. Further, front end parts of the pair of shutter springs 208 are respectively locked to both left and right end parts of the housing shutter 210S.

The housing shutter 210S is supported on the development housing 210 slidably with respect to the toner replenishing port 25. The housing shutter 210S seals or opens the toner replenishing port 25.

The aforementioned pair of shutter springs 208 bias the housing shutter 210S in such a direction that the housing shutter 210S seals the toner replenishing port 25. When the toner container 30 is detached from the developing device 20, the housing shutter 210S seals the toner replenishing port 25 by receiving biasing forces of the pair of shutter springs 208.

Further, when the toner container 30 is mounted into the container mounting portion 109, the housing shutter 210S can press the container body 37 of the toner container 30. Thus, the shutter springs 208 bias the toner container 30 mounted in the container mounting portion 109 via the housing shutter 210S in such a direction that the housing shutter 210S closes the toner replenishing port 25.

<Concerning Structure of Toner Container>

Figure 8:
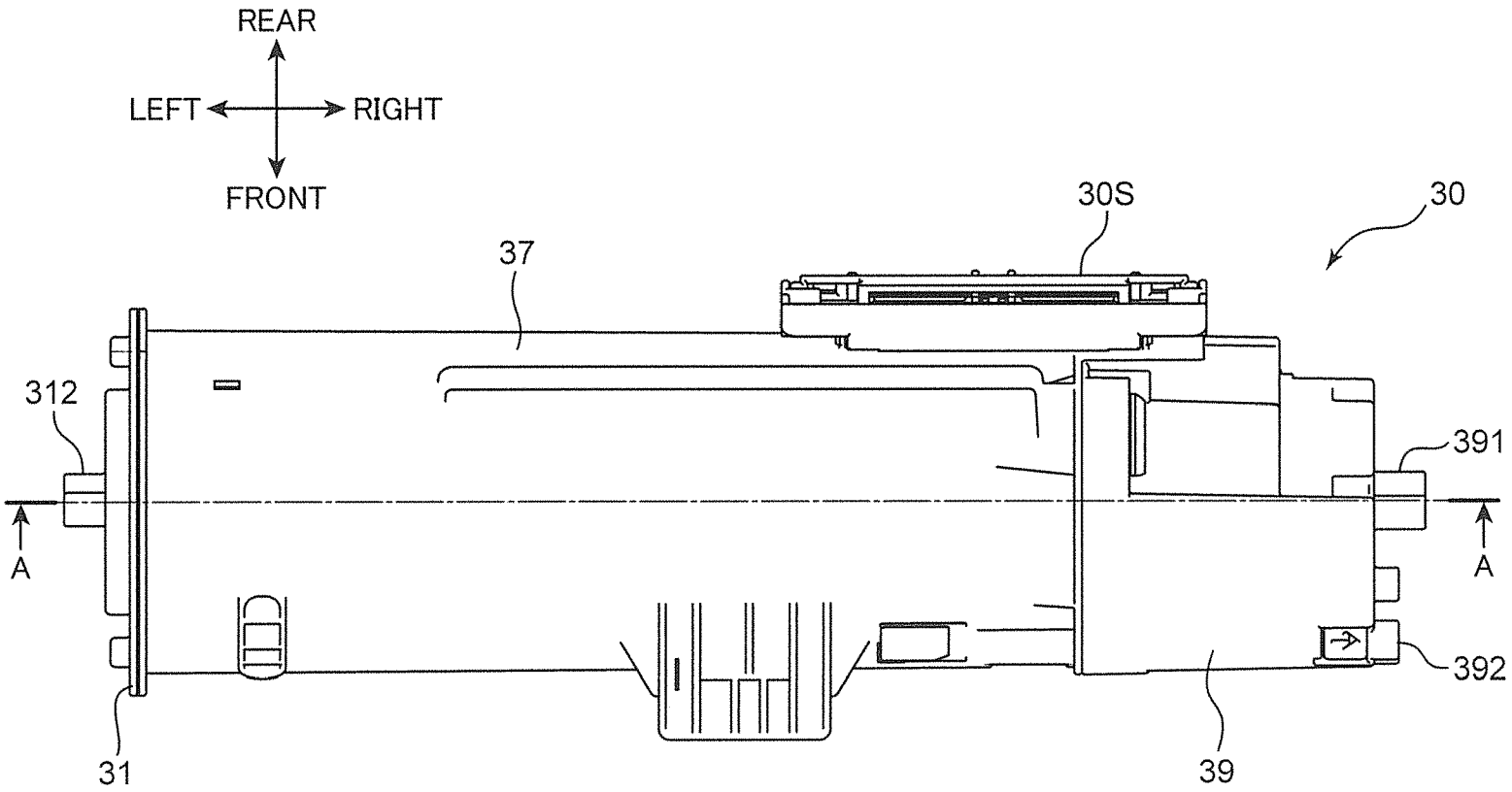
FIG. 8 is a plan view of the developer storage container according to the embodiment of the present disclosure.
Figure 9:
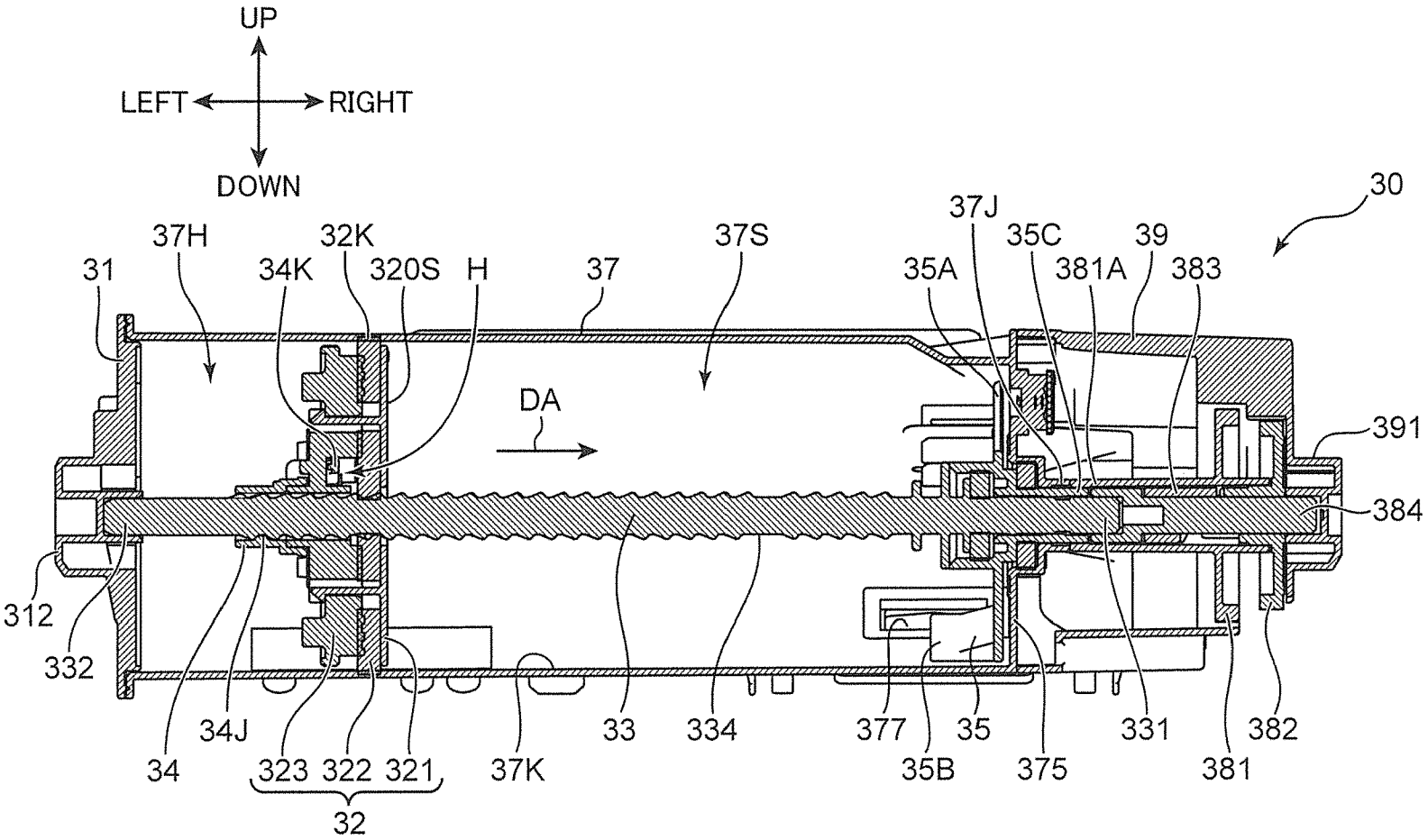
FIG. 9 is a sectional view of the developer storage container according to the embodiment of the present disclosure.
Figure 10:
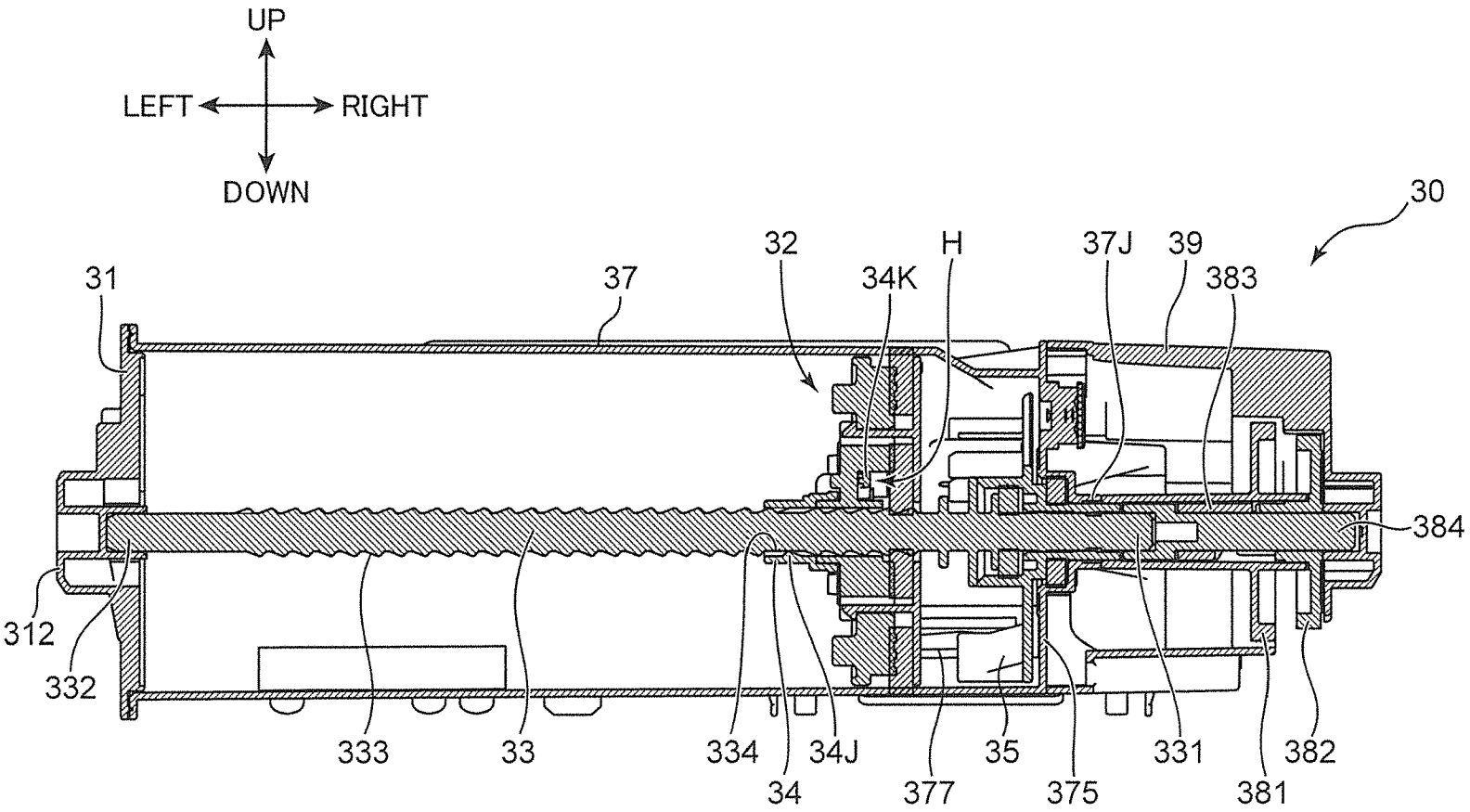
FIG. 10 is a sectional view of the developer storage container according to the embodiment of the present disclosure.
Figure 11:
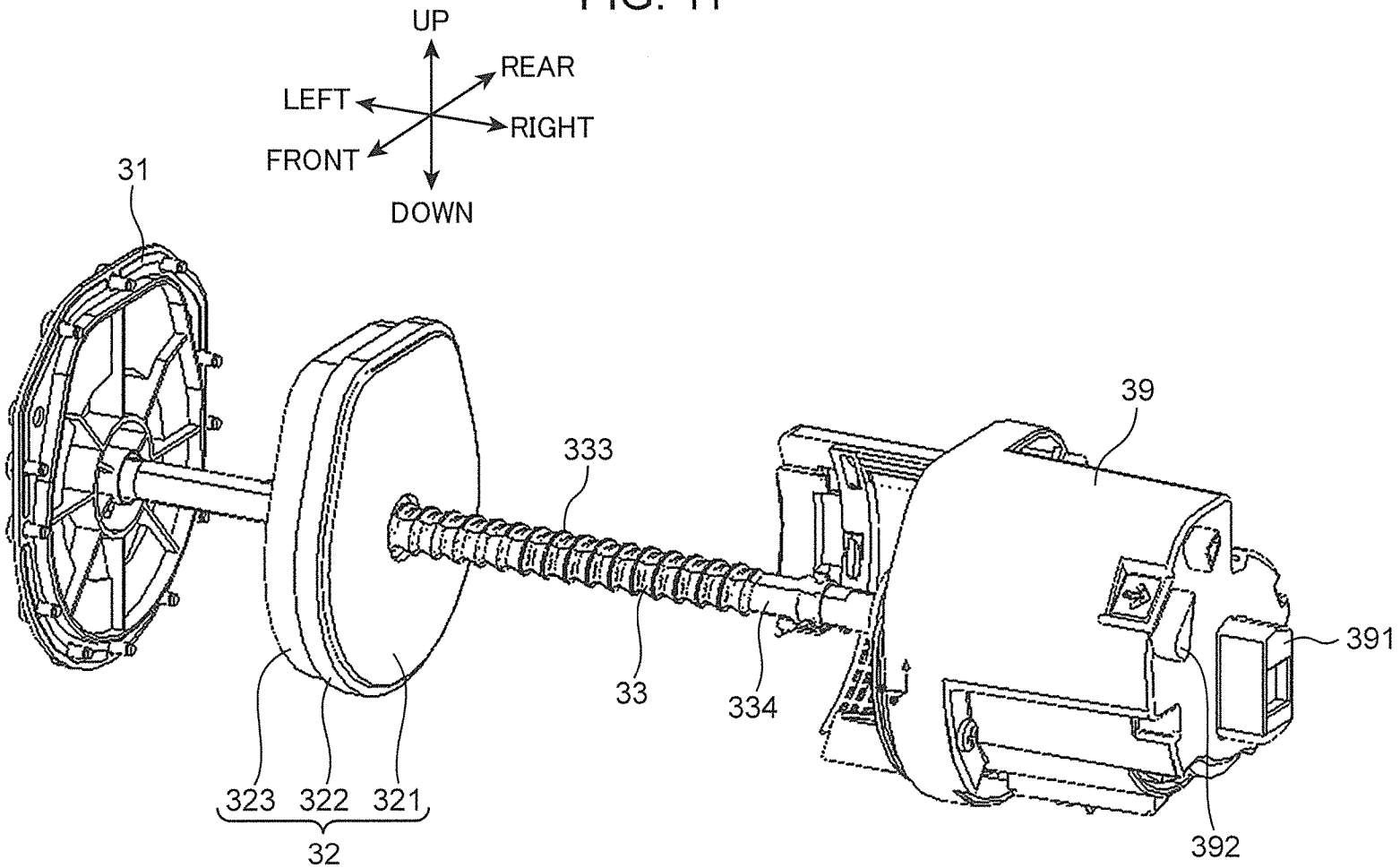
FIG. 11 is a perspective view showing an internal state of the developer storage container according to the embodiment of the present disclosure.

Next, the toner container 30 (developer storage container) according to one embodiment of the present disclosure is described with reference to FIGS. 8 to 11 in addition to FIG. 6. FIG. 8 is a plan view of the toner container 30 according to this embodiment. FIGS. 9 and 10 are sectional views along A-A of FIG. 8 of the toner container 30. Note that FIG. 9 shows a state where the moving wall 32 to be described later is arranged at an initial position and FIG. 10 shows a state where the moving wall 32 is arranged at a final position. FIG. 11 is a perspective view showing an internal state of the toner container 30 according to this embodiment with the container body 37 removed.

The toner container 30 has a tubular shape extending in the lateral direction (first direction, direction of an arrow DA of FIG. 9). The toner container 30 stores the replenishing toner (developer) inside. The toner container 30 includes the moving wall 32, the shaft 33, a pressing member 34, the stirring member 35, an unillustrated toner sensor, a first container gear 381, the second container gear 382, a ratchet gear 383 and a ratchet shaft 384 in addition to the aforementioned lid portion 31, container body 37 (container body) and cover 39.

The lid portion 31 is fixed to the container body 37 to seal an opening of the container body 37. The lid portion 31 rotatably supports a second shaft end part 332 (FIG. 9) of the shaft 33. The lid portion 31 includes the first guide portion 312. The first guide portion 312 is a projection formed to extend in the vertical direction on a left side surface (outer surface part) of the lid portion 31. The first guide portion 312 has a function of guiding the attachment of the toner container 30 to the developing device 20.

The container body 37 is a tubular body part of the toner container 30. The container body 37 has an inner peripheral surface 37K and an internal space 37H. The inner peripheral surface 37K is an inner peripheral surface of the container body 37 and has a tubular shape extending along a longitudinal direction (first direction, direction of the arrow DA of FIG. 9) of the toner container 30.

Figure 24:
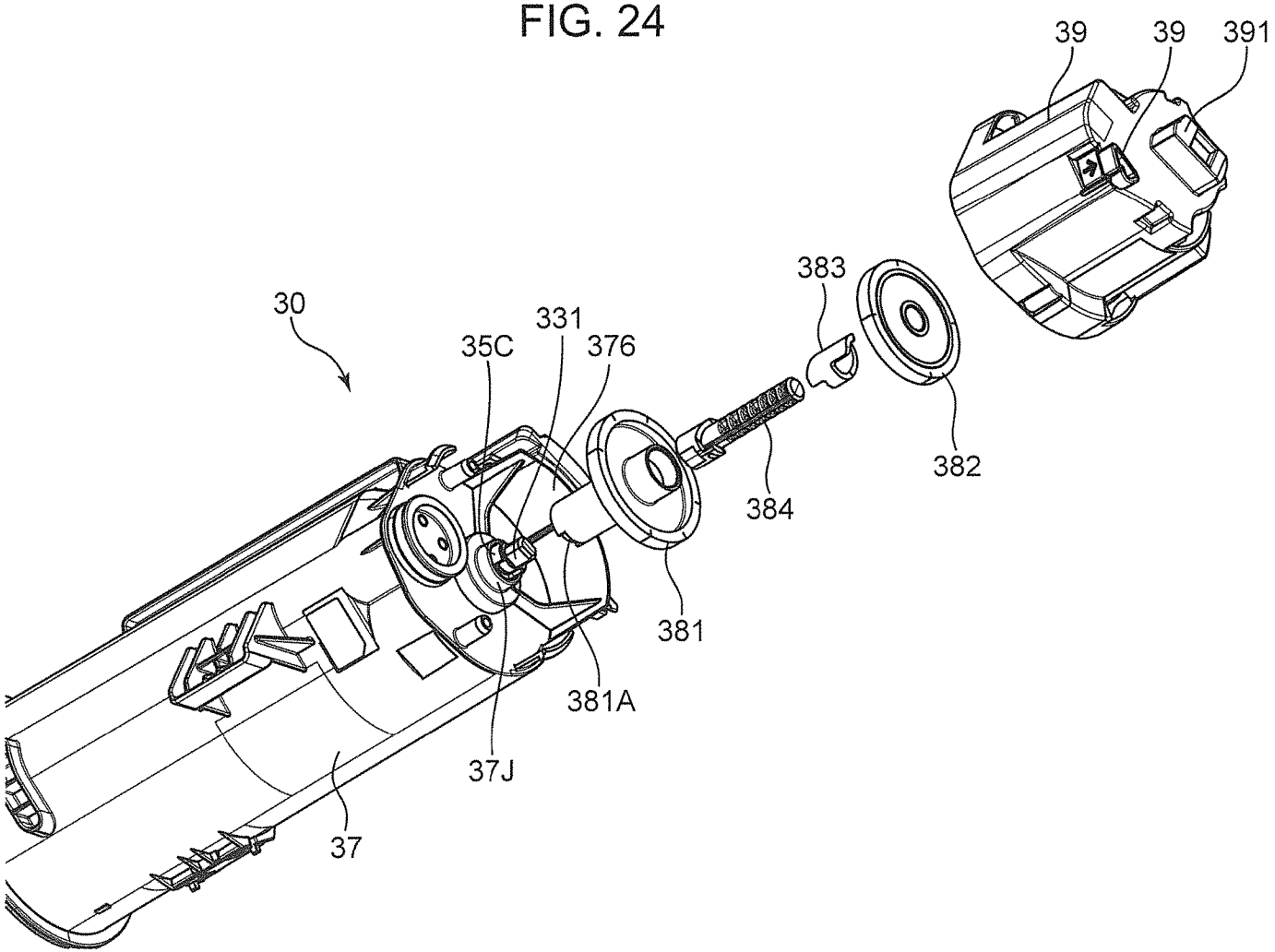
FIG. 24 is an exploded perspective view of the developer storage container according to the embodiment of the present disclosure.

Further, the container body 37 includes a right wall 375 (FIG. 9) and a projecting wall 376 (see FIG. 24). The right wall 375 is a wall portion arranged on one end side (right end side) of the container body 37 in the first direction and closing the inside of the container body 37. Note that the internal space 37H is a space defined by the inner peripheral surface 37K of the container body 37, the right wall 375 and the lid portion 31. Further, out of the internal space 37H, an area between the right wall 375 and the moving wall 32 serves as a storage space 37S. The storage space 37S is a space for storing the toner inside the toner container 30.

As shown in FIG. 9, a side of the container body 37 opposite to the right wall 375 in the first direction is open (opening). When being fixed to this opening, the lid portion 31 closes the internal space 37H of the container body 37. Note that the outer peripheral edge of the lid portion 31 is ultrasonically welded to the container body 37.

With reference to FIG. 24, the projecting wall 376 is a part where the outer peripheral surface of the container body 37 projects further rightward than the right wall 375. The cover 39 is mounted on the projecting wall 376.

Further, the container body 37 includes the aforementioned toner discharge port 377 (developer discharge port) and a body bearing portion 37J (FIG. 9). The toner discharge port 377 is an opening communicating with the inner peripheral surface 37K (internal space 37H) and open in a lower surface part of the container body 37. As shown in FIG. 9, the toner discharge port 377 is open in the lower surface part of a right end part (one end part in the first direction) of the container body 37 to communicate with the internal space 37H. In other words, the toner discharge port 377 is arranged adjacent to the right wall 375 in the first direction. Further, the toner discharge port 377 is a rectangular opening having a predetermined length along the first direction and a predetermined width along an arcuate shape of the bottom part of the container body 37. In this embodiment, the toner discharge port 377 is open at a position deviated rearward and upward along a circumferential direction from a lower end part of the bottom part of the container body 37. The toner discharge port 377 allows the toner to be discharged from the storage space 37S toward the developing device 20.

The body bearing portion 37J (FIG. 9) is a bearing formed in the right wall 375. The shaft 33 is inserted through the body bearing portion 37J. At this time, a right end side (first shaft end part 331) of the shaft 33 projects outwardly of the container body 37.

The moving wall 32 is a wall portion arranged to face in the first direction inside the container body 37 (internal space 37H). The moving wall 32 receives a drive force from the pressing member 34 according to the rotation of the shaft 33. The moving wall 32 defines one end surface (left end surface) of the storage space 37S in the first direction. Note that the other end surface (right end surface) of the storage space 37S in the first direction is defined by the right wall 375. Further, the moving wall 32 has a function of moving in the first direction in the internal space 37H from the initial position on one end side to the final position on the other end side in the first direction while conveying the toner in the storage space 37S toward the toner discharge port 377 from the start to the end of use of the toner container 30. In this embodiment, the initial position of the moving wall 32 is arranged to the right of (downstream in the first direction) the lid portion 31 (FIG. 9) and the final position is arranged immediately to the left of (upstream in the first direction) of the toner discharge port 377 (FIG. 10). Note that the structure of the moving wall 32 is further described in detail later.

The shaft 33 is rotatably supported through the right wall 375 of the container body 37 and the lid portion 31 to extend in the first direction in the internal space 37H. The shaft 33 includes the first shaft end part 331, the second shaft end part 332, an externally threaded portion 333 (first engaging portion) and a moving wall stopping portion 334.

With reference to FIG. 9, the first shaft end part 331 is a tip part of the shaft 33 projecting rightward through the body bearing portion 37J. A pair of D surfaces are formed on the peripheral surface of the first shaft end part 331 (see FIG. 24). The ratchet shaft 384 is engaged with the first shaft end part 331. As a result, the shaft 33 and the ratchet shaft 384 are integrally rotatable. The second shaft end part 332 is a left end part of the shaft 33. The second shaft end part 332 is rotatably supported in a bearing hole formed in the lid portion 31 as described above.

The externally threaded portion 333 is a spirally threaded portion formed along the first direction on the outer peripheral surface of the shaft 33 in the internal space 37H. In this embodiment, the externally threaded portion 333 is arranged from an area of the shaft 33 adjacent to the lid portion 31 to an area upstream of the toner discharge port 377 in the first direction (arrow DA of FIG. 9) as shown in FIG. 9.

The moving wall stopping portion 334 is continuously arranged on a side downstream of the externally threaded portion 333 in the first direction. The moving wall stopping portion 334 is an area formed only of a shaft part where the externally threaded portion 333 is partially missing on the shaft 33 in the internal space 37H. The moving wall stopping portion 334 is located above the toner discharge port 377 and upstream of the toner discharge port 377 in the first direction.

The pressing member 34 (FIG. 9) is arranged upstream of the moving wall 32 in the first direction. The pressing member 34 is a tubular member for allowing the passage of the shaft 33 through the inside thereof and has a function of pressing the moving wall 32 in the first direction. Note that the structure of the pressing member 34 is further described in detail later.

The stirring member 35 is arranged along the right wall 375 above the toner discharge port 377. The stirring member 35 stirs the toner in the storage space 37S and feeds the toner through the toner discharge port 377. In this embodiment, the stirring member 35 relatively rotates about the shaft 33 with respect to the shaft 33. The stirring member 35 includes a plate portion 35A, a plurality of blade portions 35B and a stirring bearing portion 35C. The plate portion 35A is a plate-like part arranged along the right wall 375, and is rotatable about the shaft 33. The plurality of blade portions 35B are blade parts extending from the plate portion 35A toward an upstream side in the first direction, i.e. toward the moving wall 32. The blade portions 35B turn around the shaft 33 above the toner discharge port 377. The stirring bearing portion 35C is a hollow cylindrical part extending rightward from the plate portion 35A and houses the shaft 33 inside. Further, a tip part of the stirring bearing portion 35C is engageable with the first container gear 381.

The first container gear 381 transmits a rotational drive force to the stirring member 35. The first container gear 381 is coupled to the second motor M2 via the first and second transmission gears 211, 212 of the developing device 20. In this embodiment, the first container gear 381 is rotationally driven in synchronization with the developing roller 21, the first stirring screw 23 and the second stirring screw 24 of the developing device 20. The first container gear 381 is coupled to the tip of the stirring bearing portion 35C of the stirring member 35 passed through the body bearing portion 37J. As a result, the first container gear 381 and the stirring member 35 integrally rotate.

The second container gear 382 transmits a rotational drive force to the shaft 33. The second container gear 382 is arranged on the same axis as the shaft 33. The second container gear 382 is coupled to the first motor M1 via the third transmission gear 213. The second container gear 382 can rotate the shaft 33 by being rotated by a drive force generated by the first motor M1. As shown in FIG. 9, a right end part of the shaft 33 is arranged through the stirring member 35. The second container gear 382 is coupled (fixed) to the tip part (first shaft end part 331) of the shaft 33 via the ratchet gear 383 and the ratchet shaft 384. Note that a ratchet structure for connecting the second container gear 382 and the shaft 33 is further described in detail later.

The cover 39 is attached to the container body 37. The cover 39 has a function of exposing circumferential parts of the first and second gears container 381, 382 to outside and covering other circumferential parts of the first and second container gears 381, 382. The cover 39 includes the aforementioned second guide portion 391 (FIGS. 9 and 11), a container engaging portion 392 and a gear opening 39K (FIG. 6).

The second guide portion 391 is a projection projecting rightward along the vertical direction on a right side surface of the cover 39. The second guide portion 391 has a function of guiding the attachment of the toner container 30 to the developing device 20 together with the first guide portion 312 of the lid portion 31. The container engaging portion 392 is a projection provided on the right side surface of the cover 39 at a distance from the second guide portion 391. The lock engaging piece 202S of the unlocking button 202 is engageable with the container engaging portion 392.

The gear opening 39K is an opening open in a lower surface part of the cover 39 and having a semicircular shape. When the cover 39 is attached to the container body 37, some of gear teeth of the first and second container gears 381, 382 are exposed to the outside of the toner container 30 via the gear opening 39K. As a result, when the toner container 30 is mounted into the development housing 210 of the developing device 20, the first and second container gears 381, 382 are respectively engaged with the second and third transmission gears 212, 213 (FIG. 7).

The toner sensor is a sensor fixed to the container body 37. The toner sensor is arranged above and adjacent to the toner discharge port 377 in the circumferential direction. The toner sensor is a sensor formed of a magnetic permeability sensor (magnetic sensor) or a piezoelectric element. If the toner sensor is formed of a piezoelectric element, a sensor part of the toner sensor is exposed to the storage space 37S. The toner sensor outputs a HIGH signal (+5 V) by being pressed by the toner in the storage space 37S. Further, if there is almost no toner above the toner sensor, the toner sensor outputs a LOW signal (0 V). An output signal of the toner sensor is referred to by the controller 50 (FIG. 7). Note that, if the toner sensor is a magnetic permeability sensor, the sensor needs not directly contact the toner. Thus, the toner sensor may be fixed to an outer wall of the container body 37. Further, in another embodiment, the toner sensor may be arranged on the side of the development housing 210 (device body side) of the developing device 20 to face the outer wall of the container body 37.

<Concerning Movement of Moving Wall>

The toner container 30 is mounted into the container mounting portion 109 by a user while the first guide portion 312 of the lid portion 31 and the second guide portion 391 of the cover 39 are guided by the pair of the left guide groove 201L and the right guide groove 201R of the developing device 20 (FIGS. 6, 7). When the toner container 30 is mounted into the container mounting portion 109, the container shutter 30S is moved to open the toner discharge port 377. As a result, the toner discharge port 377 is arranged to face the toner replenishing port 25 from above (FIGS. 4, 5).

As just described, when a new toner container 30 is mounted in the printer 100, the controller 50 (FIG. 7) drives the first motor M1 to rotationally drive the shaft 33 via the second container gear 382 engaged with the third transmission gear 213. As a result, the pressing member 34 moves the moving wall 32 toward the toner discharge port 377 in the first direction (arrow DA of FIG. 9) by the engagement of the externally threaded portion 333 of the shaft 33 and a later-described internally threaded portion 34J of the pressing member 34. Eventually, when the moving wall 32 moves rightward from the initial position by a predetermined distance, the storage space 37S is filled with the toner and the toner sensor outputs a HIGH signal corresponding to a fully filled state. Upon receipt of the HIGH signal output from the toner sensor, the controller 50 stops the rotation of the shaft 33 to stop a movement of the moving wall 32.

As described above, the volume replenishment type toner replenishing method is adopted in this embodiment as shown in FIG. 5. Thus, if the staying portion 29 (FIG. 5) in the developing device 20 seals the toner replenishing port 25 from below, the replenishing toner does not fall from the toner container 30. On the other hand, if the toner is supplied from the developing roller 21 of the developing device 20 to the photoconductive drum 121 and the toner in the staying portion 29 decreases, the toner flows from the toner discharge port 377 into the developing device 20 via the toner replenishing port 25. As a result, the toner around the toner sensor is lost in the storage space 37S of the toner container 30, wherefore the toner sensor outputs a LOW signal. Upon receipt of this signal, the controller 50 drives the first motor M1 to further move the moving wall 32 toward the toner discharge port 377 until the toner sensor outputs a HIGH signal.

Note that the controller 50 drives the second motor M2 to rotationally drive the developing roller 21 and the like according to a developing operation in the developing device 20. In conjunction with this rotating operation, the stirring member 35 is rotated via the first container gear 381 engaged with the second transmission gear 212. As a result, the stirring member 35 arranged on a right end side of the storage space 37S rotates about the shaft 33, wherefore the toner above the toner discharge port 377 is stably stirred. Thus, the fluidity of the toner increases and the toner stably falls through the toner discharge port 377.

When a printing operation is repeated and the toner in the storage space 37S of the toner container 30 is continuously used, the moving wall 32 eventually reaches the final position immediately before the toner discharge port 377. The moving wall 32 gradually moves in the first direction in this way, whereby the toner in the storage space 37S is conveyed to the toner discharge port 377 while being pressed by the moving wall 32. At this time, the storage space 37S is gradually reduced in size until the moving wall 32 reaches the final position. Thus, a space where the toner remains is gradually lost inside the toner container 30. As a result, the amount of the toner remaining in the storage space 37S of the container body 37 is reduced when use is finished as compared to conventional toner containers in which the volume of a storage space remains unchanged.

Note that, in this embodiment, the moving wall 32 is stopped at the final position slightly upstream of the toner discharge port 377 in the first direction. Specifically, when the internally threaded portion 34J of the pressing member 34 reaches the moving wall stopping portion 334 according to a movement of the moving wall 32, the externally threaded portion 333 and the internally threaded portion 34J are disengaged. As a result, a moving force is no longer transmitted from the shaft 33 to the moving wall 32 and the moving wall 32 stops at the final position.

<Concerning Detailed Structure of Moving Wall>

Figure 12:
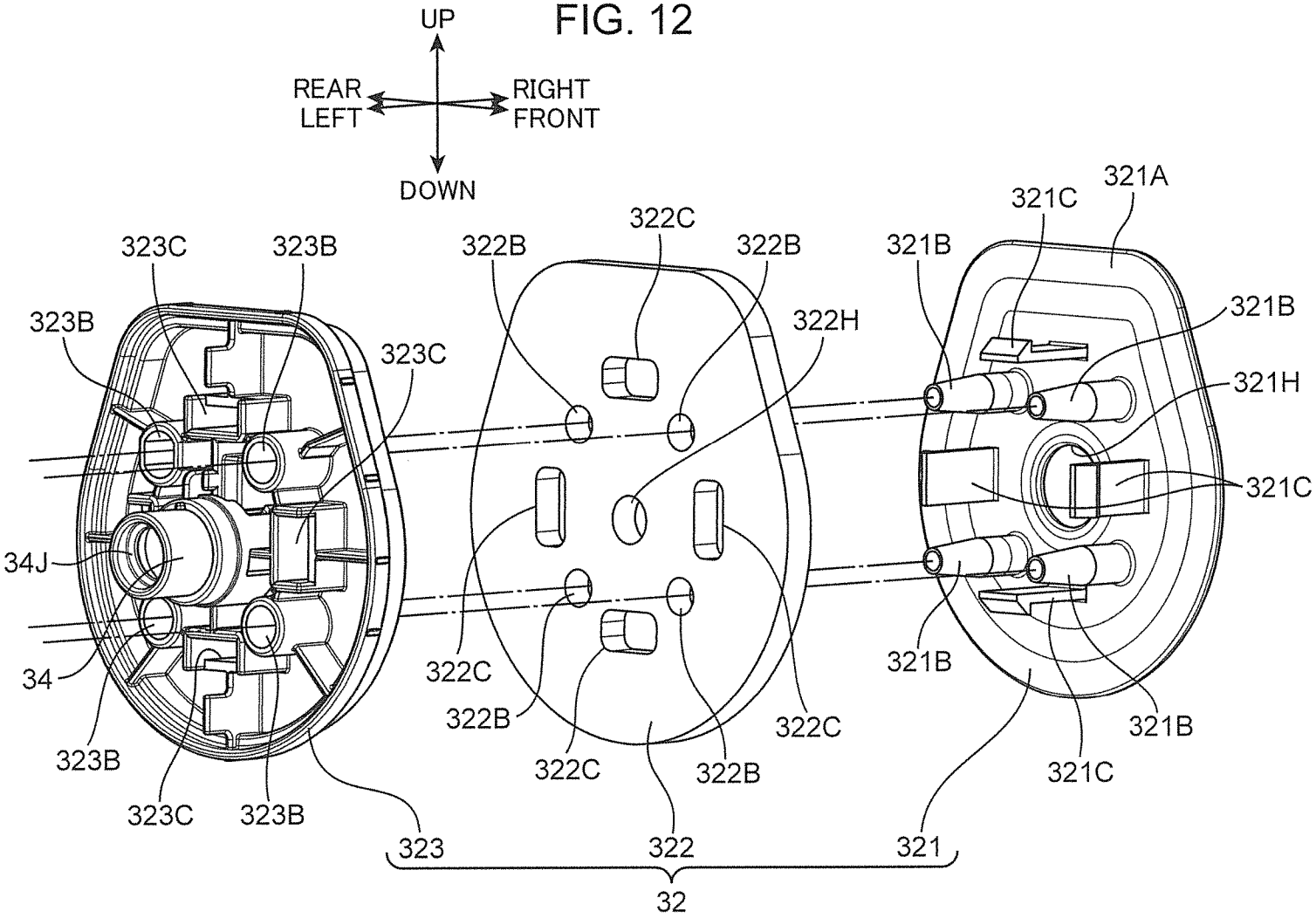
FIG. 12 is an exploded perspective view of a moving wall of the developer storage container according to the embodiment of the present disclosure.
Figure 13:
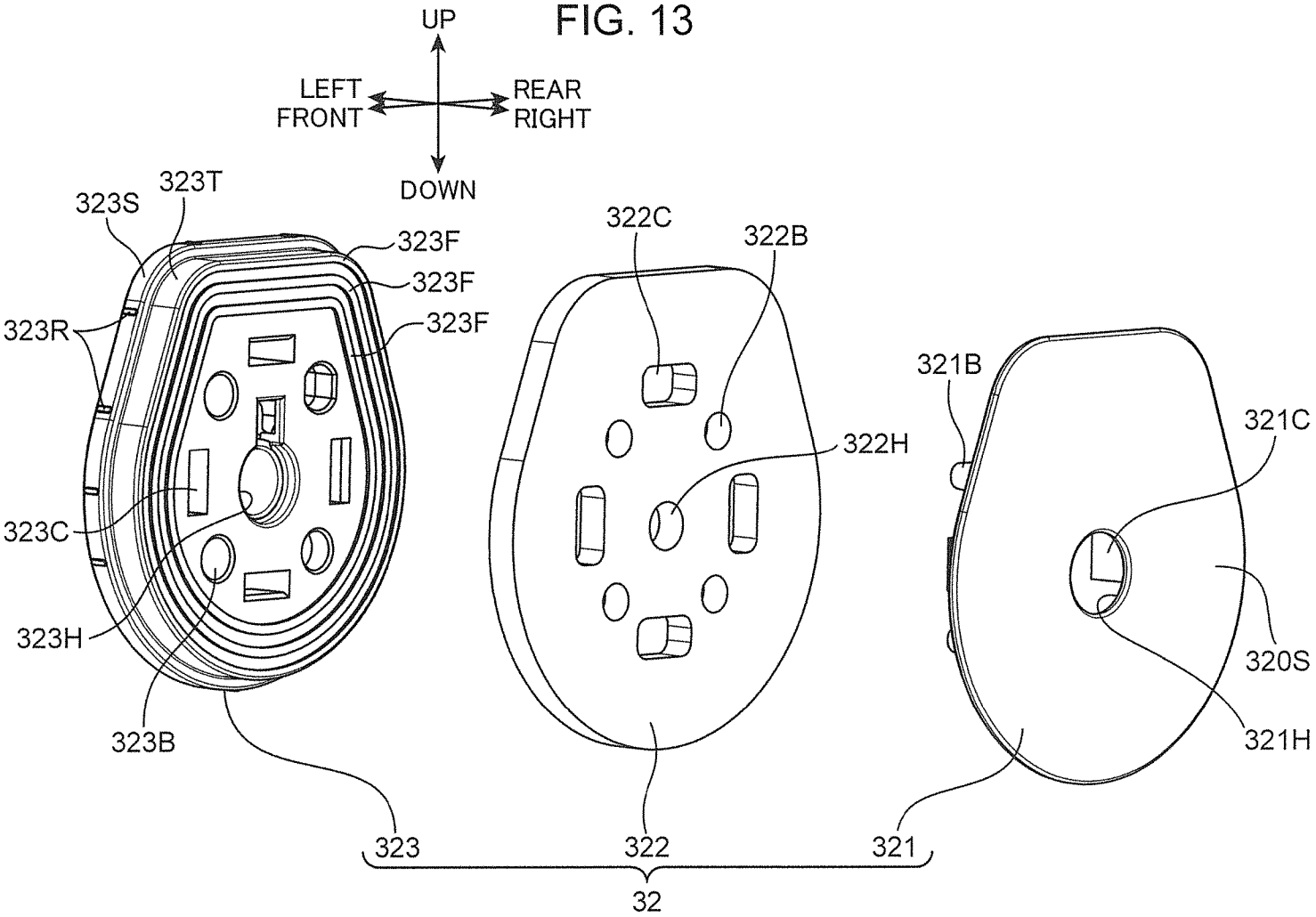
FIG. 13 is an exploded perspective view of the moving wall of the developer storage container according to the embodiment of the present disclosure.
Figure 14:
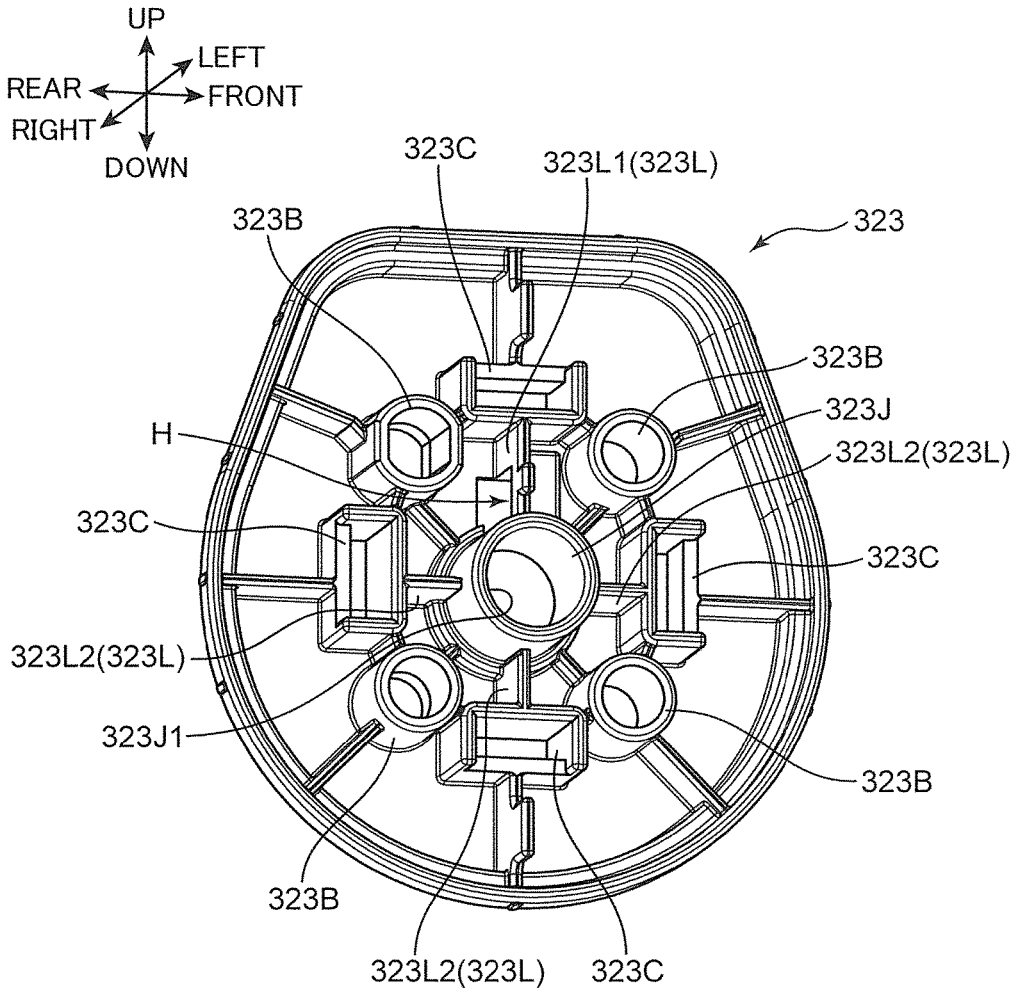
FIG. 14 is a perspective view of a wall body portion of the moving wall of the developer storage container according to the embodiment of the present disclosure.
Figure 15:
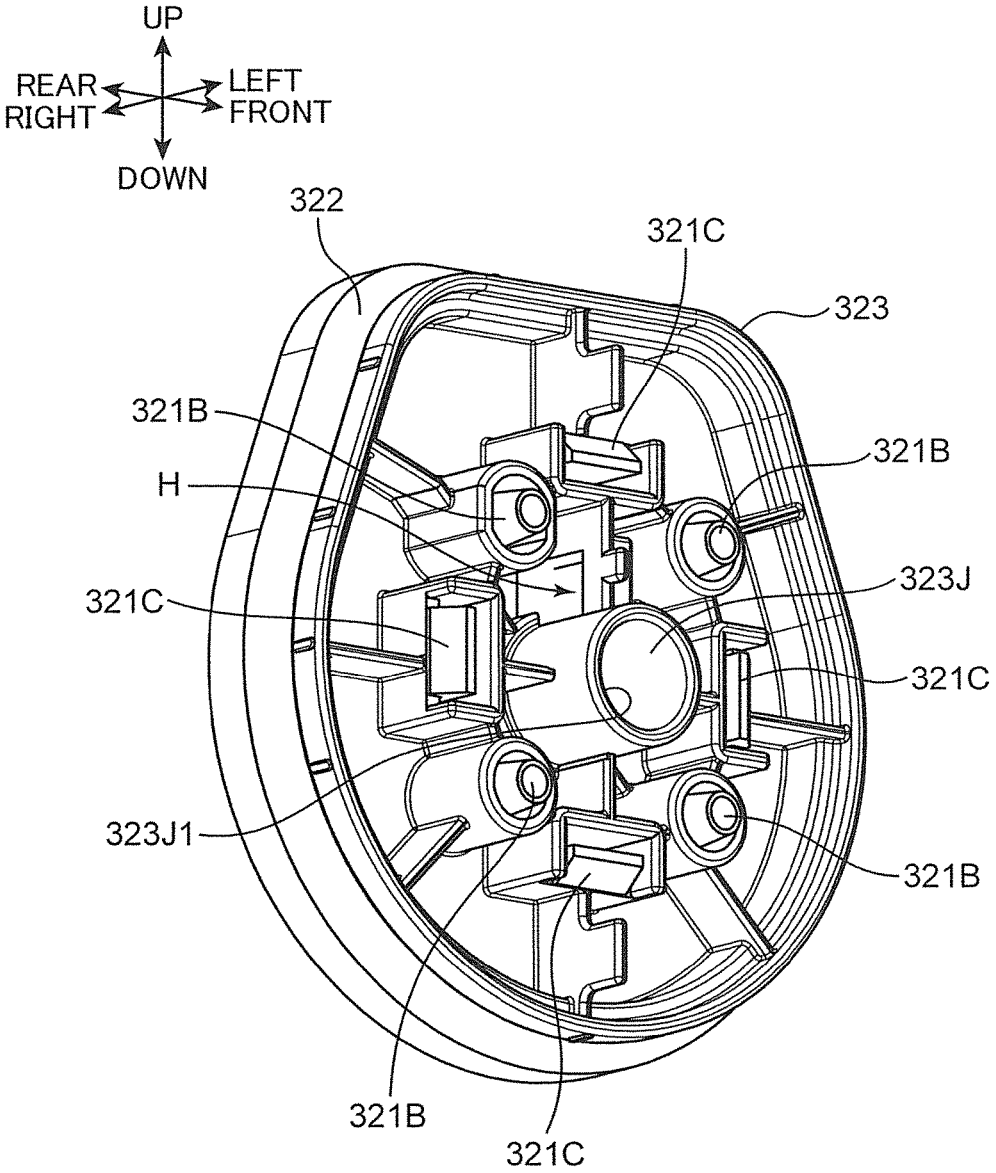
FIG. 15 is a perspective view of the moving wall of the developer storage container according to the embodiment of the present disclosure.

FIGS. 12 and 13 are exploded perspective views of the moving wall 32 of the toner container 30 according to this embodiment, respectively viewed from different viewpoints. Note that the pressing member 34 is also shown in FIG. 12. FIG. 14 is a perspective view of a wall body portion 323 of the moving wall 32. FIG. 15 is a perspective view of the moving wall 32.

With reference to FIGS. 12 and 13, the moving wall 32 includes a wall plate 321, a seal member 322 and the wall body portion 323. In other words, the moving wall 32 is composed of three plate-like members in this embodiment. Note that outer peripheral parts of the wall plate 321, the seal member 322 and the wall body portion 323 are similarly shaped to each other. Specifically, a lower end part of the moving wall 32 has an arcuate shape projecting downward, an upper end part of the moving wall 32 is formed by a horizontal flat part and both side parts of the moving wall 32 are formed by inclined parts connecting the above arcuate shape and flat part.

The wall plate 321 is arranged on a most downstream side of the moving wall 32 in the first direction. The wall plate 321 is formed by resin molding. The wall plate 321 includes a plate body 321A, four (a plurality of) studs 321B and four (a plurality of) engaging pieces 321C. The plate body 321A is a plate-like body part of the wall plate 321 and facing in the lateral direction. A plate shaft hole 321H (first bearing portion) is open in a central part of the plate body 321A. The shaft 33 is inserted through the plate shaft hole 321H. Further, a right side surface of the plate body 321A constitutes a conveying surface 320S. The conveying surface 320S defines the storage space 37S for storing the toner together with the inner peripheral surface 37K of the container body 37. Further, the conveying surface 320S conveys the toner in the storage space 37S while pressing the toner according to a movement of the moving wall 32.

Each of the four studs 321B projects leftward (toward the wall body portion 323) from a left side surface of the plate body 321A. The stud 321B has a cylindrical shape and a tip part thereof is tapered. In this embodiment, two studs 321B are arranged at a distance in the front-rear direction above the plate shaft hole 321H, and two studs 321B are arranged at a distance in the front-rear direction below the plate shaft hole 321H. The four studs 321B have a function of positioning the wall plate 321 with respect to the wall body portion 323.

Each of the four engaging pieces 321C projects leftward (toward the wall body portion 323) from the left side surface of the plate body 321B similarly to the studs 321B. The engaging piece 321C is hook-shaped and a tip part thereof is claw-shaped. In this embodiment, one engaging piece 321C is arranged right above the plate shaft hole 321H, two engaging pieces 321C are arranged before and behind the plate shaft hole 321H and one engaging piece 321C is arranged below the plate shaft hole 321H. In other words, the four engaging pieces 321C are respectively arranged between adjacent ones of the four studs 321B in a circumferential direction. The four engaging pieces 321C have a function of fixing the wall plate 321 to the wall body portion 323.

The seal member 322 is arranged at a position in a central part of the moving wall 32 in the first direction to be sandwiched between the wall plate 321 and the wall body portion 323. The seal member 322 is formed of a urethane material having a predetermined thickness in the first direction. A seal shaft hole 322H (first bearing portion) is open in a central part of the seal member 322. The shaft 33 is inserted through the seal shaft hole 322H. Further, four stud insertion holes 322B and four engaging piece insertion holes 322C are respectively open around the seal shaft hole 322H in the seal member 322. The four stud insertion holes 322B allow the respective four studs 321B described above to pass therethrough. Similarly, the four engaging piece insertion holes 322C allow the respective four engaging pieces 321C described above to pass therethrough. As a result, the position of the seal member 322 with respect to the wall plate 321 and the wall body portion 323 of the moving wall 32 is restricted. In other words, the seal member 322 is restrained in the vertical and lateral directions. Note that an outer peripheral part of the seal member 322 constitutes an outer peripheral surface 32K of the moving wall 32 (FIG. 9). The outer peripheral surface 32K is arranged in contact with the inner peripheral surface 37K of the container body 37 and compressively deformed.

The wall body portion 323 is arranged on a side upstream of the wall plate 321 and the seal member 322 in the first direction, i.e. on a most upstream side of the moving wall 32 in the first direction. The wall body portion 323 is formed by resin molding. As shown in FIG. 13, the wall body portion 323 includes a large diameter portion 323S and a small diameter portion 323T. Specifically, the wall body portion 323 has a stepped shape along the first direction so that a downstream side in the first direction (small diameter portion 323T) is one size smaller than an upstream side in the first direction (large diameter portion 323S). A hollow cylindrical portion 323J (wall hollow cylindrical portion) is arranged in a central part of the wall body portion 323 (FIG. 14). The hollow cylindrical portion 323J has a hollow cylindrical shape projecting toward an upstream side in the first direction from the wall body portion 323. A wall body shaft hole 323H (first bearing portion) (FIG. 13) is formed in the hollow cylindrical interior of the hollow cylindrical portion 323J. The shaft 33 is inserted through the wall body shaft hole 323H. Further, the hollow cylindrical portion 323J is inserted into the hollow cylindrical interior of the pressing member 34. A tip part (front end part) of the hollow cylindrical portion 323J on the upstream side in the first direction is formed into a ring shape and functions as a pressed portion 323J1 (FIG. 14) to be pressed by the pressing member 34 to be described later. The pressed portion 323J1 is in contact with a later-described pressing surface 34F of the pressing member 34 in the entire circumferential direction of the shaft 33.

Further, as shown in FIG. 14, the wall body portion 323 includes four stud receiving portions 323B, four wall engaging portions 323C and four wall surface ribs 323L. The four stud receiving portions 323B allow the respective four studs 321B described above to pass therethrough. Similarly, the four wall engaging portions 323C allow the respective four engaging pieces 321C described above to engage with (FIG. 15). The four wall surface ribs 323L are ribs projecting from a left side surface of the wall body portion 323, and extend to connect the stud receiving portions 323B and the wall engaging portions 323C. Note that the four wall surface ribs 323L include one first wall surface rib 323L1 and three second wall surface ribs 323L2. The first wall surface rib 323L1 extends upward from an upper end part of the hollow cylindrical portion 323J. The three second wall surface ribs 323L2 respectively extend radially outward from left, right and lower end parts of the hollow cylindrical portion 323J. The first wall surface rib 323L1 is formed with an insertion hole H (engaged portion). The insertion hole H is an opening formed to penetrate through the first wall surface rib 323L1 in the front-rear direction, and a pressing member engaging portion 34K of the pressing member 34 to be described later is insertable thereinto.

Further, with reference to FIG. 13, three seal pressing ribs 323F annular in the circumferential direction of the shaft 33 and projecting toward the seal member 322 are provided on the right side surface of the wall body portion 323 to surround the four stud receiving portions 323B and the four wall engaging portions 323C. The three seal pressing ribs 323F are respectively ribs similar to an outer peripheral shape of the wall body portion 323 and arranged at a distance from each other in a radial direction. The outermost seal pressing rib 323F is arranged near an outer peripheral part of the small diameter portion 323T. Further, the innermost seal pressing rib 323F is arranged in proximity to the four stud receiving portions 323B and the four wall engaging portions 323C. These seal pressing ribs 323F have a function of coming into contact with a side surface of the seal member 322 to press the seal member 322 and restricting a base end position of a compressively deformed part of the seal member 322 in the radial direction.

Further, with reference to FIG. 13, a plurality of outer peripheral ribs 323R are arranged at intervals in the circumferential direction on an outer peripheral part of the large diameter portion 323S. The plurality of outer peripheral ribs 323R maintain the posture of the moving wall 32 by being slightly held in contact with the inner peripheral surface 37K of the container body 37.

With reference to FIGS. 9 and 13, when the wall plate 321, the seal member 322 and the wall body portion 323 are integrated, the outer peripheral part of the seal member 322 is arranged on a radially outermost side. As a result, the outer peripheral part of the seal member 322 (outer peripheral surface 32K of the moving wall 32) is compressively deformed by the inner peripheral surface 37K of the container body 37. As a result, it is prevented that the toner in the storage space 37S flows to a side upstream of the moving wall 32 in a moving direction from a clearance between the inner peripheral surface 37K of the container body 37 and the outer peripheral surface 32K of the moving wall 32. At this time, the position of the radially base end part of the compressively deformed part is restricted by the plurality of seal pressing ribs 323F. Thus, the compressed part of the outer peripheral part of the seal member 322 is limited and a strong pressing force toward the inner peripheral surface 37K of the container body 37 can be maintained. Further, the outer peripheral part of the large diameter portion 323S of the wall body portion 323 and the outer peripheral part of the wall plate 321 are arranged slightly radially inward of the outer peripheral part of the seal member 322. By sandwiching the surface-like (plate-like) seal member 322 by the wall plate 321 and the wall body portion 323 in this way, it is suppressed that the outer peripheral part of the seal member 322 is separated according to a movement of the moving wall 32. In other words, the occurrence of seal turn-up is prevented as compared to the case where a tape-like seal member is wound on the outer peripheral part of the moving wall 32. Further, the small diameter portion 323T is arranged radially inward of the large diameter portion 323S. As a result, when the moving wall 32 moves in the first direction, the outer peripheral part of the seal member 322 is allowed to enter a step part between the large diameter portion 323S and the small diameter portion 323T on the upstream side in the first direction. Thus, it is prevented that an excessive load is applied to the outer peripheral part of the seal member 322 to break this outer peripheral part.

Further, with reference to FIGS. 12 and 13, when the seal member 322 is sandwiched between the wall plate 321 and the wall body portion 323, a part of the seal member 322 around the seal shaft hole 322H is squeezed, whereby a shaft seal portion is formed to be held in close contact with the outer peripheral surface of the shaft 33 in the entire circumferential direction. The shaft seal portion is arranged on a side downstream of the internally threaded portion 34J of the pressing member 34 to be described later in the first direction (FIG. 9). Thus, the shaft seal portion contacts the externally threaded portion 333 of the shaft 33 earlier than the internally threaded portion 34J to clean the toner adhering to the externally threaded portion 333. Further, since being ring-shaped to surround the shaft 33, the shaft seal portion is held in close contact with the shaft 33 in the entire circumferential direction of the shaft 33. This prevents the toner in the storage space 37S to flow out to a side upstream of the moving wall 32 in the moving direction through a bearing part of the moving wall 32.

<Concerning Structure of Pressing Member>

Figure 16:
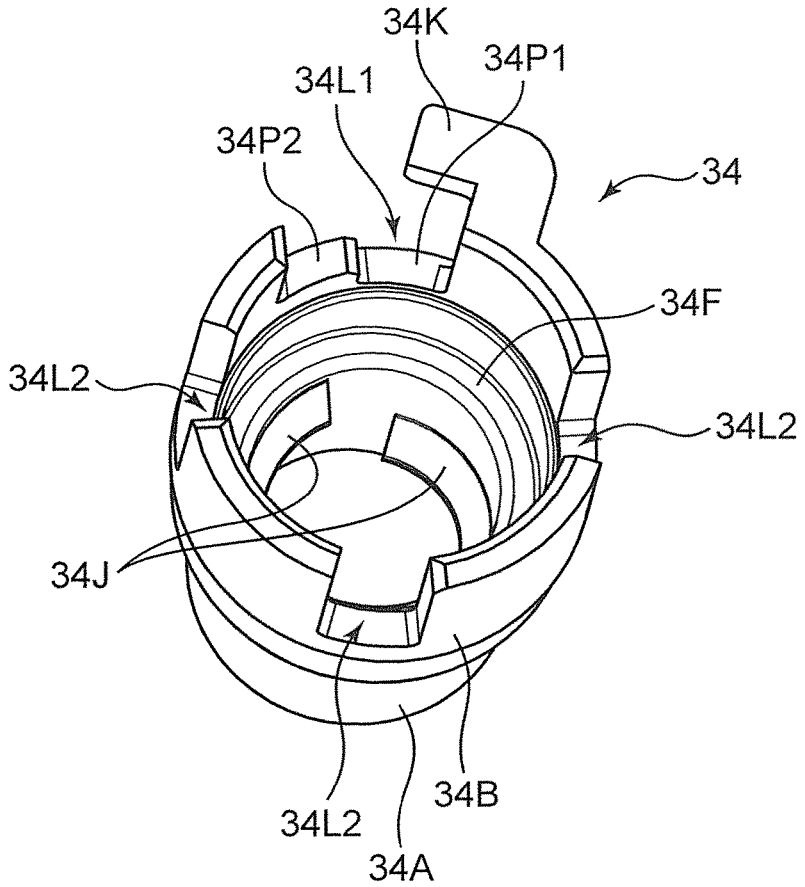
FIG. 16 is a perspective view of a pressing member of the developer storage container according to the embodiment of the present disclosure.
Figure 17:
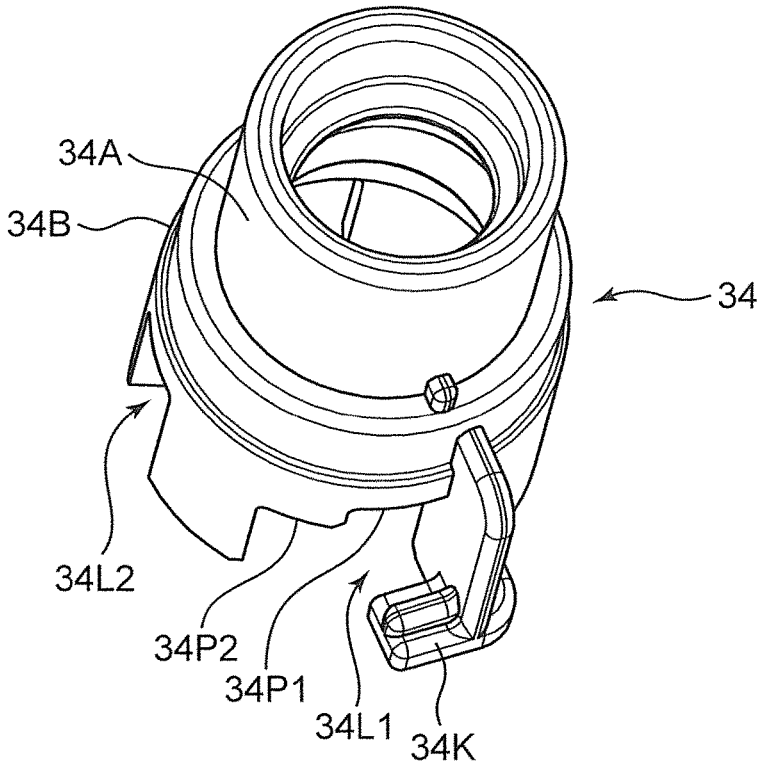
FIG. 17 is a perspective view of the pressing member of the developer storage container according to the embodiment of the present disclosure.
Figure 18:
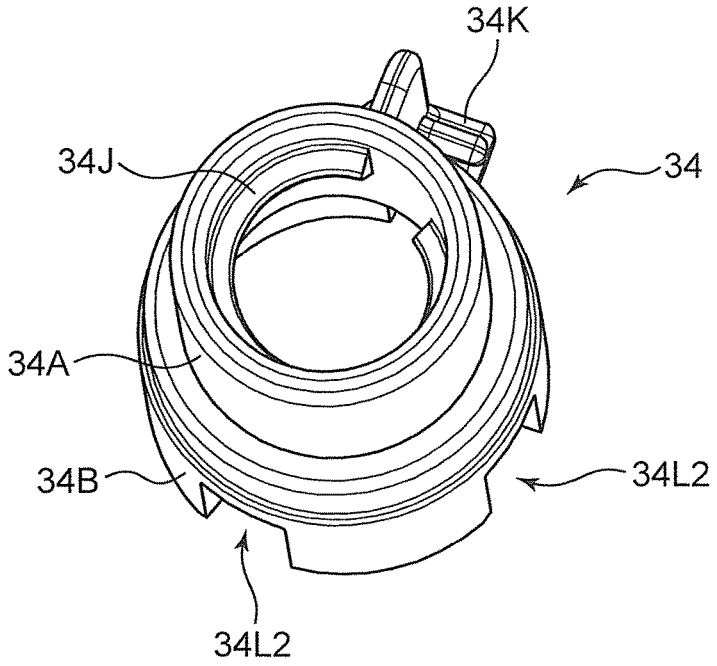
FIG. 18 is a perspective view of the pressing member of the developer storage container according to the embodiment of the present disclosure.
Figure 19:
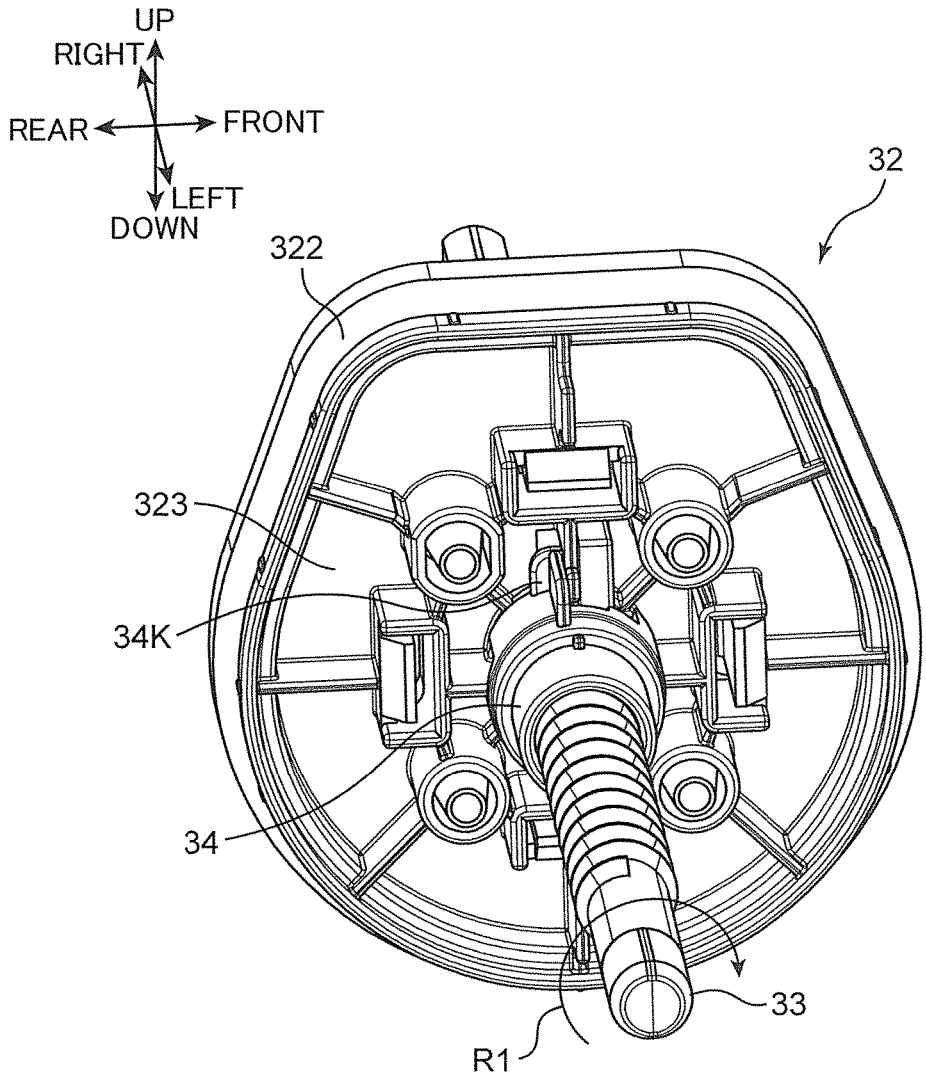
FIG. 19 is a perspective view of the moving wall, the pressing member and a shaft of the developer storage container according to the embodiment of the present disclosure in a state where the pressing member is engaged with the moving wall.
Figure 20:
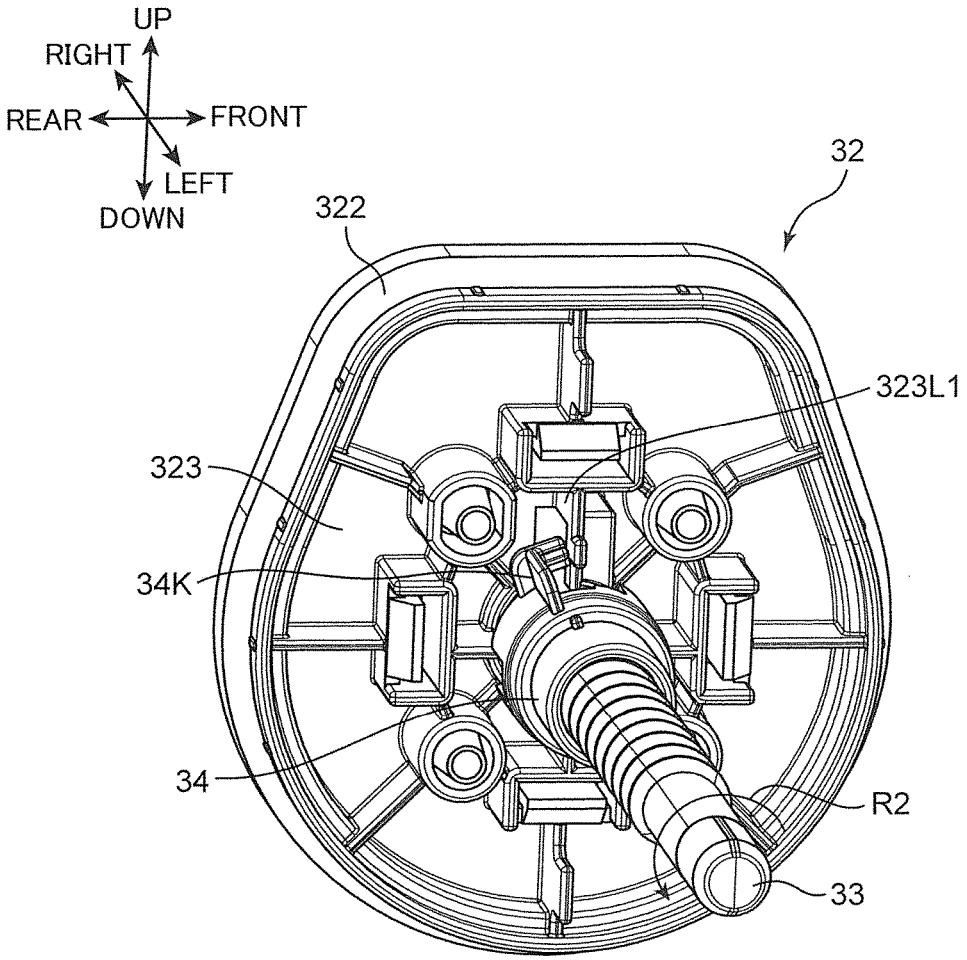
FIG. 20 is a perspective view of the moving wall, the pressing member and the shaft of the developer storage container according to the embodiment of the present disclosure in a state where the pressing member and the moving wall are disengaged.
Figure 21:
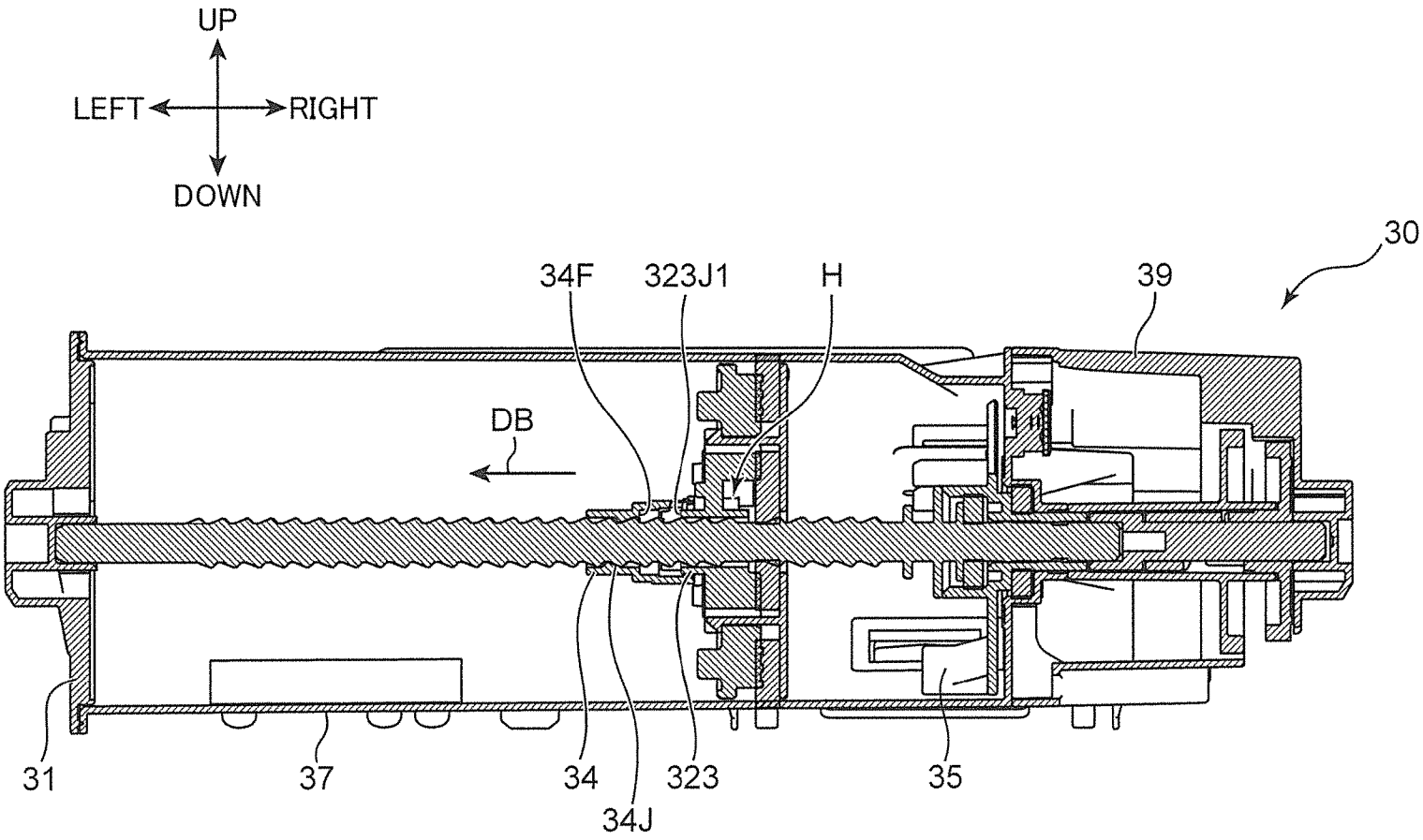
FIG. 21 is a sectional view of the developer storage container according to the embodiment of the present disclosure in the state where the pressing member and the moving wall are disengaged.
Figure 22:
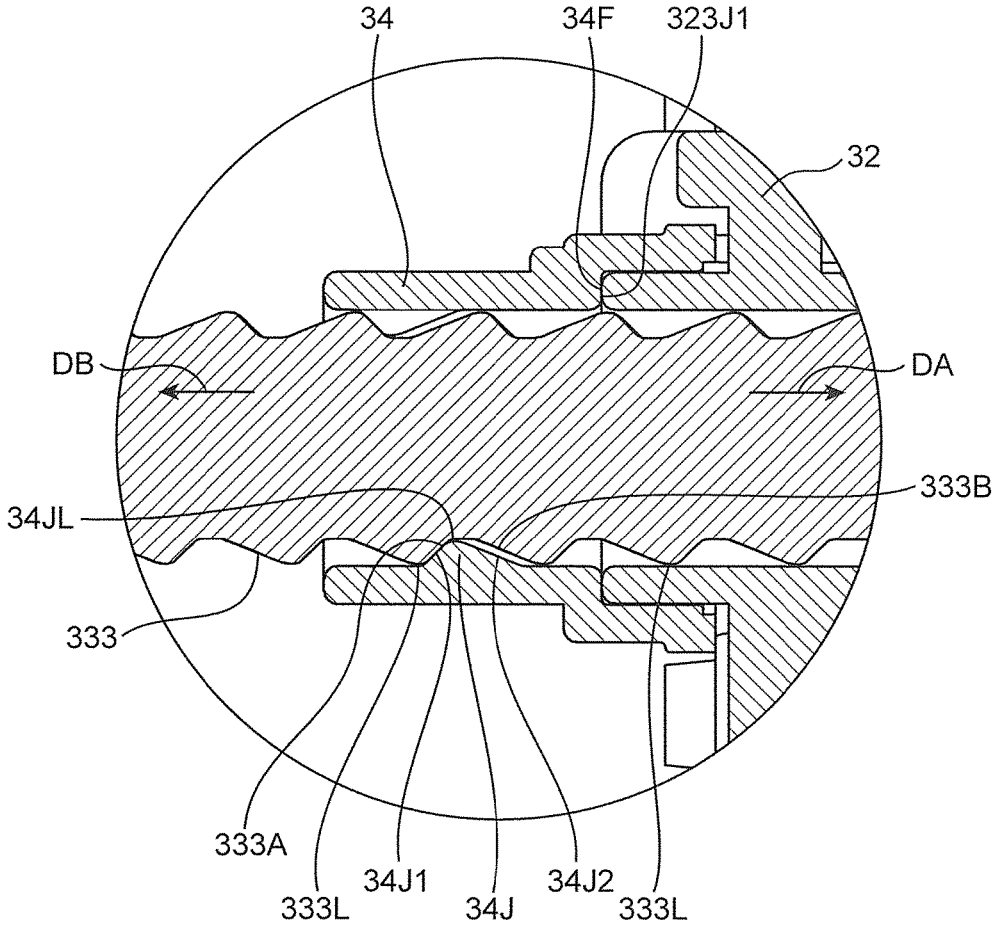
FIG. 22 is a sectional view enlargedly showing a part of the developer storage container of FIG. 9.

FIGS. 16 to 18 are respectively perspective views of the pressing member 34 of the toner container 30 according to this embodiment. FIG. 19 is a perspective view of the moving wall 32, the pressing member 34 and the shaft 33 of the toner container 30 in a state where the pressing member 34 is engaged with the moving wall 32. FIG. 20 is a perspective view of the moving wall 32, the pressing member 34 and the shaft 33 of the toner container 30 in a state where the pressing member 34 and the moving wall 32 are disengaged. FIG. 21 is a sectional view of the toner container 30 in the state where the pressing member 34 and the moving wall 32 are disengaged. FIG. 22 is an enlarged sectional view of a part (pressing member 34) of the toner container 30 of FIG. 9.

The pressing member 34 is arranged upstream of the moving wall 32 in the first direction (FIG. 9). The pressing member 34 has a hollow cylindrical shape. Note that the outer peripheral surface of the pressing member 34 is arranged radially inward of and at a distance from the inner peripheral surface 37K of the container body 37 (FIG. 9). The pressing member 34 includes a first hollow cylindrical portion 34A (second bearing portion) and a second hollow cylindrical portion 34B. The first hollow cylindrical portion 34A has a slightly smaller diameter than the second hollow cylindrical portion 34B and is arranged upstream of the second hollow cylindrical portion 34B in the first direction. The shaft 33 is passed through the first and second hollow cylindrical portions 34A, 34B. The pressing member 34 includes the internally threaded portion 34J (second engaging portion), a pressing surface 34F (pressing portion) and the pressing member engaging portion 34K.

The internally threaded portion 34J is a spirally threaded portion formed on the inner peripheral surface of the first hollow cylindrical portion 34A. The internally threaded portion 34J has a function of moving the pressing member 34 in the first direction by being engaged with the externally threaded portion 333 of the shaft 33.

The pressing surface 34F has a function of pressing the moving wall 32 to a downstream side in the first direction. The pressing surface 34F is formed into a ring shape in a step part between the first and second hollow cylindrical portions 34A, 34B in the hollow cylindrical interior of the pressing member 34. The pressing surface 34F presses the pressed portion 323J1 (FIG. 14) of the moving wall 32 in the first direction in the entire circumferential direction about the shaft 33.

The pressing member engaging portion 34K includes a tip part radially projecting from a downstream part of the outer peripheral surface of the second hollow cylindrical portion 34B in the first direction and extending in the circumferential direction. The aforementioned insertion hole H of the moving wall 32 allows the tip part of the pressing member engaging portion 34K to be engaged therewith along the circumferential direction (FIGS. 19 and 20).

Further, a first cut portion 34L1 and three second cut portions 34L2 are respectively formed on a downstream side of the second hollow cylindrical portion 34B in the first direction (FIG. 16). The first cut portion 34L1 is defined by a first facing surface 34P1 and a second facing surface 34P2 having a step therebetween. The first facing surface 34P1 is arranged radially inward of the tip part (bent part) of the pressing member engaging portion 34K. Further, each of the three second cut portions 34L2 is a rectangular cut formed in an end surface of the second hollow cylindrical portion 34B. When the pressing member 34 presses the moving wall 32, the first wall surface rib 323L1 and the second wall surface ribs 323L2 (FIG. 14) are respectively inserted into the first cut portion 34L1 and the second cut portions 34L2.

Note that the pressing member 34 moves in the first direction integrally with the moving wall 32 by the pressing surface 34F pressing the moving wall 32 according to the engagement of the externally threaded portion 333 and the internally threaded portion 34 when the shaft 33 is rotated in a predetermined first rotating direction (arrow R1 of FIG. 19). Further, the pressing member 34 relatively moves to the upstream side in the first direction with respect to the moving wall 32 according to the engagement of the externally threaded portion 333 and the internally threaded portion 34 when the shaft 33 is rotated in a second rotating direction (arrow R2 of FIG. 20) opposite to the first rotating direction.

With reference to FIGS. 21 and 22, this embodiment is characterized by the shapes of a thread of the externally threaded portion 333 and that of the internally threaded portion 34J. Specifically, with reference to FIG. 22, the externally threaded portion 333 has a first male slope 333A (first inclined surface) and a second male slope 333B (second inclined surface).

The first male slope 333A is formed by an inclined surface arranged downstream of a ridge 333L of the externally threaded portion 333 in the first direction and inclined to taper the externally threaded portion 333 in the first direction. In other words, the first male slope 333A is inclined to extend radially inward along the first direction. Further, the second male slope 333B is formed by an inclined surface arranged upstream of the ridge 333L of the externally threaded portion 333 in the first direction and inclined to widen the externally threaded portion 333 in the first direction on a side opposite to the first male slope 333A. In other words, the second male slope 333B is inclined to extend radially outward along the first direction. Further, the second male slope 333B is more gently inclined with respect to the first direction than the first male slope 333A.

Further, the internally threaded portion 34J has a first female slope 34J1 (third inclined surface) and a second female slope 34J2 (fourth inclined surface).

The first female slope 34J1 is formed by an inclined surface arranged upstream of a ridge 34JL of the internally threaded portion 34J in the first direction and inclined to widen the internally threaded portion 34J in the first direction. In other words, the first female slope 34J1 is inclined to extend radially inward along the first direction. The second female slope 34J2 is formed by an inclined surface arranged downstream of the ridge 34JL of the internally threaded portion 34J in the first direction and inclined to taper the internally threaded portion 34J in the first direction on a side opposite to the first female slope 34J1. In other words, the second female slope 34J2 is inclined to extend radially outward along the first direction. Further, the second female slope 34J2 is more gently inclined with respect to the first direction than the first female slope 34J1.

According to this configuration, a rotational torque applied to the shaft 33 according to the engagement of the second male slope 333B of the externally threaded portion 333 and the second female slope 34J2 of the internally threaded portion 34J when the shaft 33 is rotated in the second rotating direction (arrow R2 of FIG. 20) is larger than a rotational torque applied to the shaft 33 according to the engagement of the first male slope 333A of the shaft 33 and the first female slope 34J1 of the internally threaded portion 34J when the shaft 33 is rotated in the first rotating direction (arrow R1 of FIG. 19). The externally threaded portion 333 is at the same pitch regardless of whether the shaft 33 is rotated in the first rotating direction or in the second rotating direction. However, in the case of rotation in the second rotating direction, a component in a radial direction of a force generated by the contact of the second male slope 333B and the second female slope 34J2 is large, wherefore a large torque is generated for the shaft 33. Accordingly, a load for rotating the shaft 33 becomes large and a movement amount of the pressing member 34 can be made small. Therefore, the pressing member 34 and the moving wall 32 are easily fitted again manually or according to the rotation of the shaft 33.

<Concerning Ratchet Structure>

Figure 23:
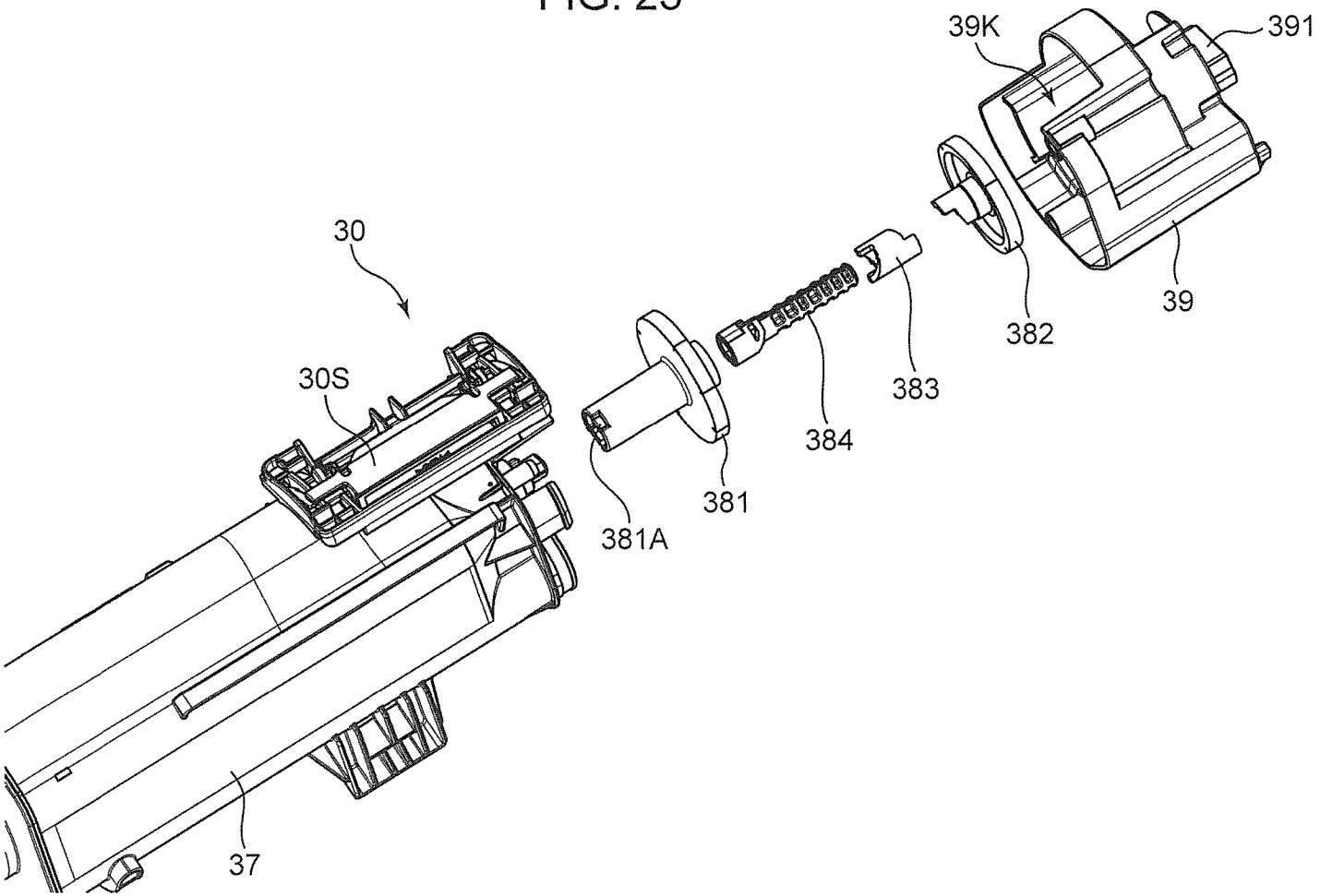
FIG. 23 is an exploded perspective view of the developer storage container according to the embodiment of the present disclosure.
Figure 25:
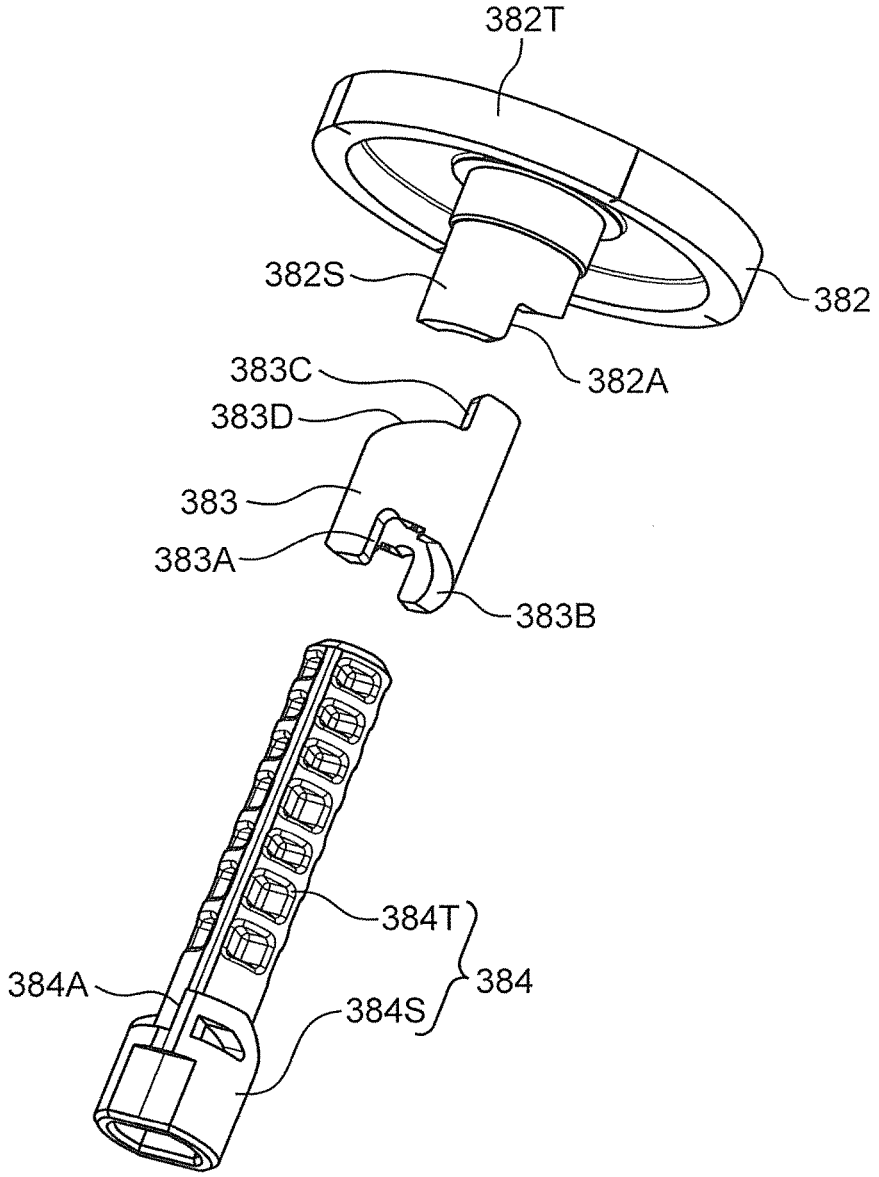
FIG. 25 is an exploded perspective view of a ratchet mechanism of the developer storage container according to the embodiment of the present disclosure.
Figure 26:
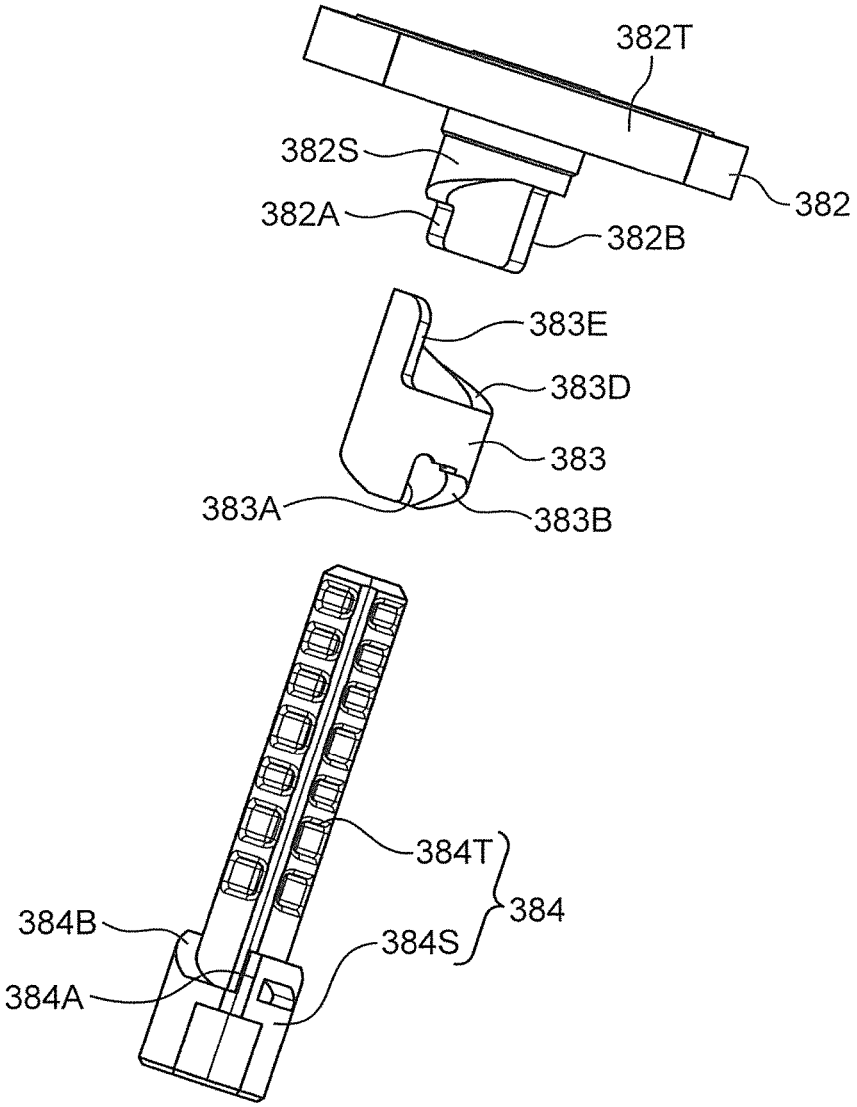
FIG. 26 is an exploded perspective view of the ratchet mechanism of the developer storage container according to the embodiment of the present disclosure.
Figure 27:
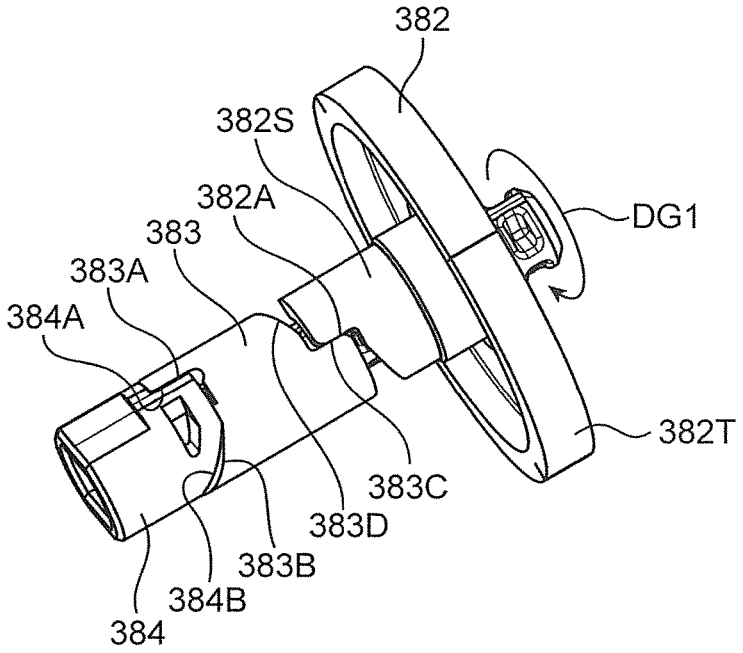
FIG. 27 is a perspective view of the ratchet mechanism of the developer storage container according to the embodiment of the present disclosure.
Figure 28:
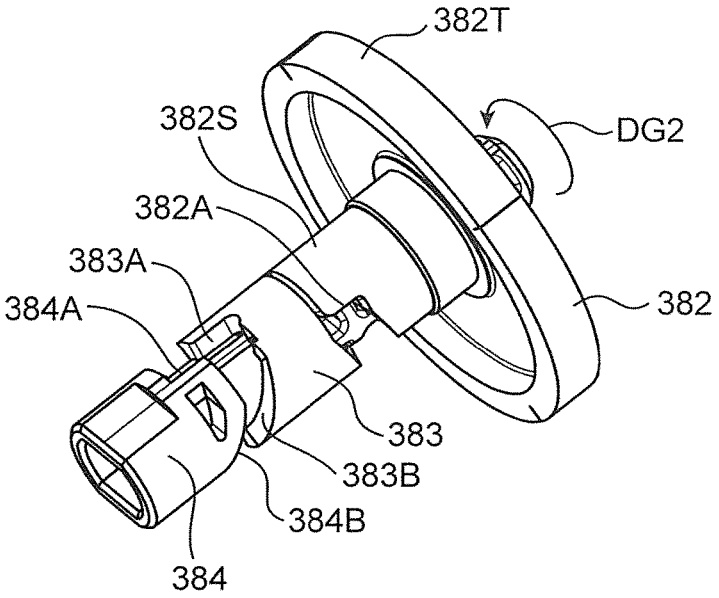
FIG. 28 is a perspective view of the ratchet mechanism of the developer storage container according to the embodiment of the present disclosure.

FIGS. 23 and 24 are exploded perspective views of the toner container 30 according to this embodiment. FIGS. 25 and 26 are exploded perspective views of the ratchet mechanism of the toner container 30. FIGS. 27 and 28 are perspective views of the ratchet mechanism of the toner container 30.

In this embodiment, the second container gear 382, the ratchet gear 383 and the ratchet shaft 384 constitute the ratchet mechanism for transmitting a rotational drive force to the shaft 33.

With reference to FIGS. 25 and 26, the second container gear 382 includes a hollow cylindrical portion 382S and a disc-like gear portion 382T connected to the hollow cylindrical portion 382S. Unillustrated gear teeth are formed on an outer peripheral part of the gear portion 382T. A shaft portion 384T of the ratchet shaft 384 is insertable into the hollow cylindrical portion 382S. The hollow cylindrical portion 382S includes an engaging portion 382A extending in an axial direction of the ratchet shaft 384 (axial direction of the shaft 33).

The ratchet gear 383 has a hollow cylindrical shape and the shaft portion 384T of the ratchet shaft 384 is insertable thereinto. The ratchet gear 383 is arranged between the shaft 33 and the second container gear 382 in the axial direction and rotatable about an axis of the shaft 33. The ratchet gear 383 includes an engaging portion 383A extending in the axial direction of the ratchet shaft 384 and an inclined portion 383B facing the engaging portion 383A in a circumferential direction. Further, the ratchet gear 383 includes an engaging portion 383C arranged on a side opposite to the engaging portion 383A and the inclined portion 383B in the axial direction and extending in the axial direction of the ratchet shaft 384, and an inclined portion 383D facing the engaging portion 383C in the circumferential direction.

Further, the ratchet shaft 384 is arranged between the second container gear 382 and the shaft 33 in the axial direction and rotatable integrally with the shaft 33. The ratchet shaft 384 includes a base end part 384S and the shaft portion 384T. The base end part 384S has a substantially hollow cylindrical shape. The hollow cylindrical interior of the base end part 384S has a pair of D surface shapes. The first shaft end part 331 (FIG. 24) of the shaft 33 is inserted and engaged inside the base end part 384S. As a result, the shaft 33 and the ratchet shaft 384 are integrally rotatable. The shaft portion 384T extends in the axial direction from the base end part 384S. An outer diameter of the shaft portion 384T is smaller than that of the base end part 384S. An engaging portion 384A extending in the axial direction of the ratchet shaft 384 and an inclined portion 384B facing the engaging portion 384A in the circumferential direction are provided on an end part of the base end part 384S on the side of the shaft portion 384T.

As shown in FIGS. 27 and 28, the hollow cylindrical portion 382S of the second container gear 382 is externally fitted on the ratchet shaft 384 after the ratchet gear 383 is externally fitted on the ratchet shaft 384. As a result, the engaging portion 382A is arranged to face the engaging portion 383C and the engaging portion 384A is arranged to face the engaging portion 383A in the circumferential direction about the ratchet shaft 384. If the second container gear 382 is rotated in the first rotating direction (arrow R1 of FIG. 19, arrow DG1 of FIG. 27), the engaging portion 382A moves along the inclined portion 383D to press the ratchet gear 383 toward the base end part 384S in the axial direction. Eventually, the engaging portion 382A comes into contact with the engaging portion 383C to press the engaging portion 383C in the first rotating direction. Further, the engaging portion 383A comes into contact with the engaging portion 384A to press the engaging portion 384A in the first rotating direction. As a result, the shaft 33 coupled to the ratchet shaft 384 rotates in the first rotating direction. Specifically, the pressing member 34 and the moving wall 32 move in the first direction (DA).

On the other hand, if the second container gear 382 is rotated in the second rotating direction (arrow R2 of FIG. 20, arrow DG2 of FIG. 28), the engaging portion 382A is separated from the engaging portion 383C in the circumferential direction. Further, the engaging portion 382B (FIG. 26) of the second container gear 382 presses an engaging portion 383E (FIG. 26) of the ratchet gear 383 in the second rotating direction. As a result, the ratchet gear 383 rotates in the second rotating direction. At this time, since the ratchet shaft 384 does not press the ratchet gear 383 toward the shaft portion 384T, the ratchet gear 383 and the ratchet shaft 384 (engaging portion 384A) are disengaged and the ratchet gear 383 idly rotates in the second rotating direction. As a result, a rotational force in the second rotating direction is not transmitted to the ratchet shaft 384, with the result that the shaft 33 does not rotate in the second rotating direction. Specifically, as the second container gear 382 rotates in the second rotating direction, movements of the pressing member 34 and the moving wall 32 in the first direction (DA) are suppressed. Further, since the shaft 33 does not rotate in the second rotating direction, the pressing member 34 does not relatively move to the upstream side in the first direction with respect to the moving wall 32. Thus, even if a user erroneously rotates the second container gear 382 in the second rotating direction when the toner container 30 is detached from the developing device 20 of the printer 100, a movement of the moving wall 32 to the upstream side in the first direction is prevented.

As just described, in this embodiment, the ratchet mechanism constituted by the second container gear 382, the ratchet gear 383 and the ratchet shaft 384 transmits a rotational drive force of the second container gear 382 in the first rotating direction to the shaft 33 and cuts off the transmission of a rotational drive force of the second container gear 382 in the second rotating direction to the shaft 33.

Note that, in this embodiment, the first container gear 381 has a hollow cylindrical shape to enclose a coupled part of the first shaft end part 331 of the shaft 33 and the base end part 384S of the ratchet shaft 384 (FIGS. 23 and 24). Thus, regardless of a coupled state of the first container gear 381 and the shaft 33, a rotational force of the first container gear 381 can be stably transmitted to the stirring bearing portion 35C (FIG. 24) of the stirring member 35.

<Concerning Attachment and Detachment of Toner Container>

Figure 29:
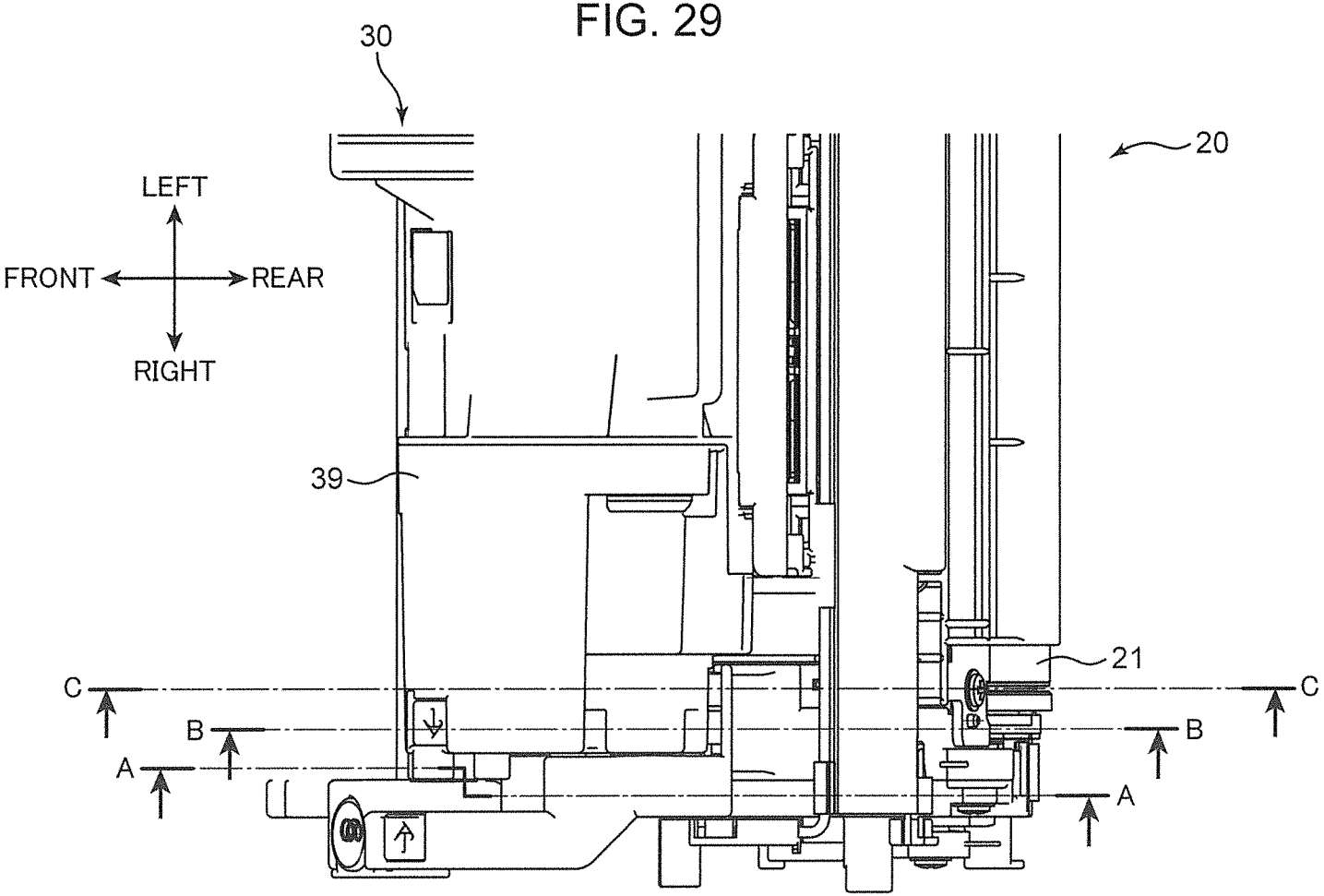
FIG. 29 is an enlarged plan view of the developer storage container according to the embodiment of the present disclosure.
Figure 30:
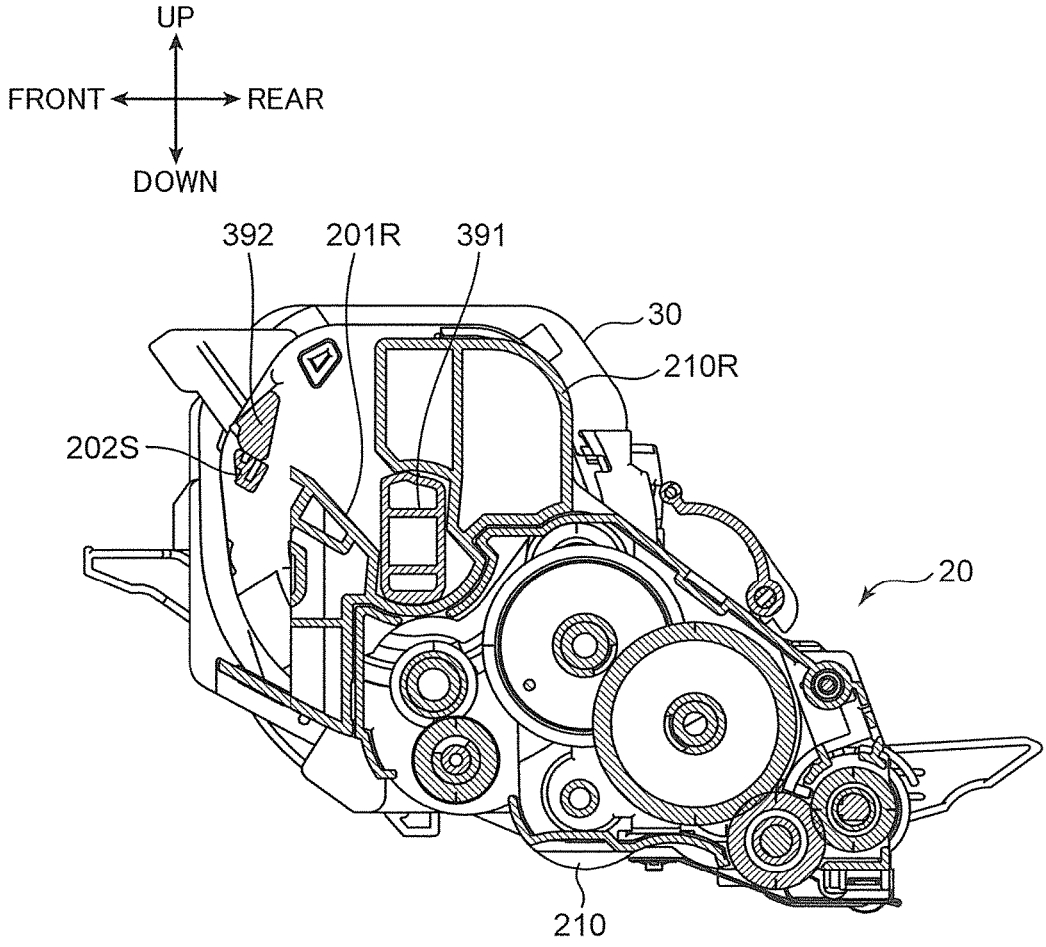
FIG. 30 is a sectional view of the developer storage container according to the embodiment of the present disclosure.
Figure 31:
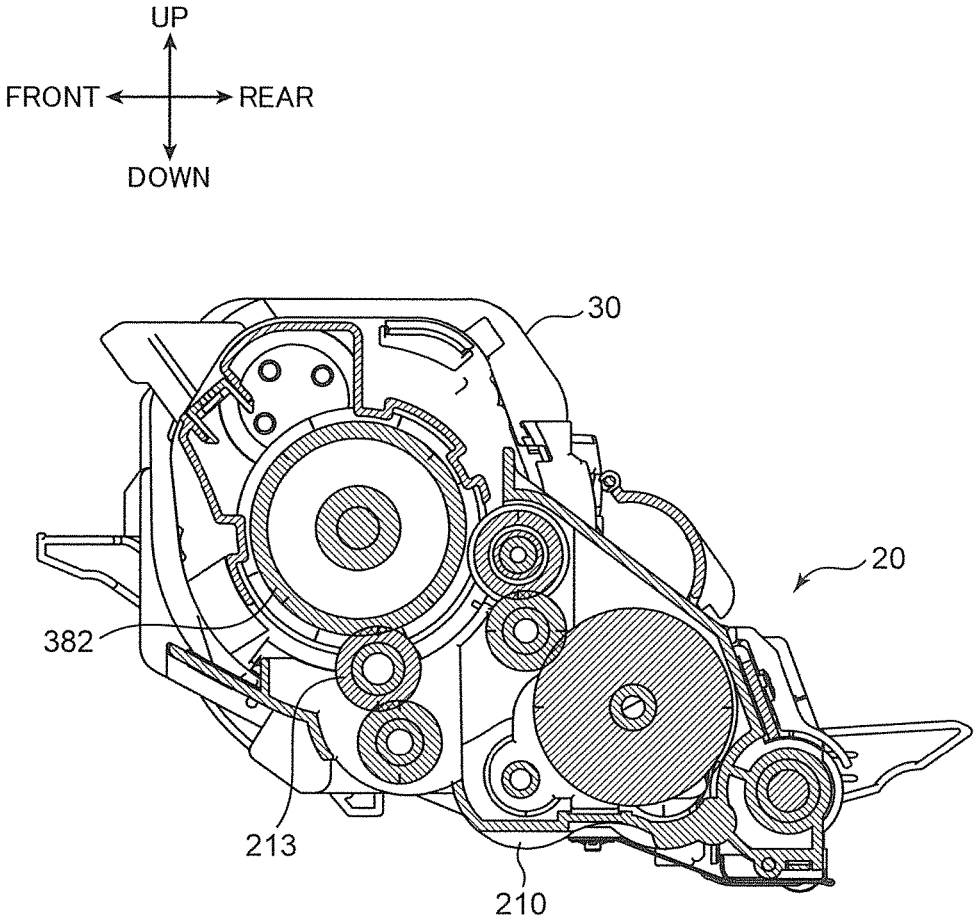
FIG. 31 is a sectional view of the developer storage container according to the embodiment of the present disclosure.
Figure 32:
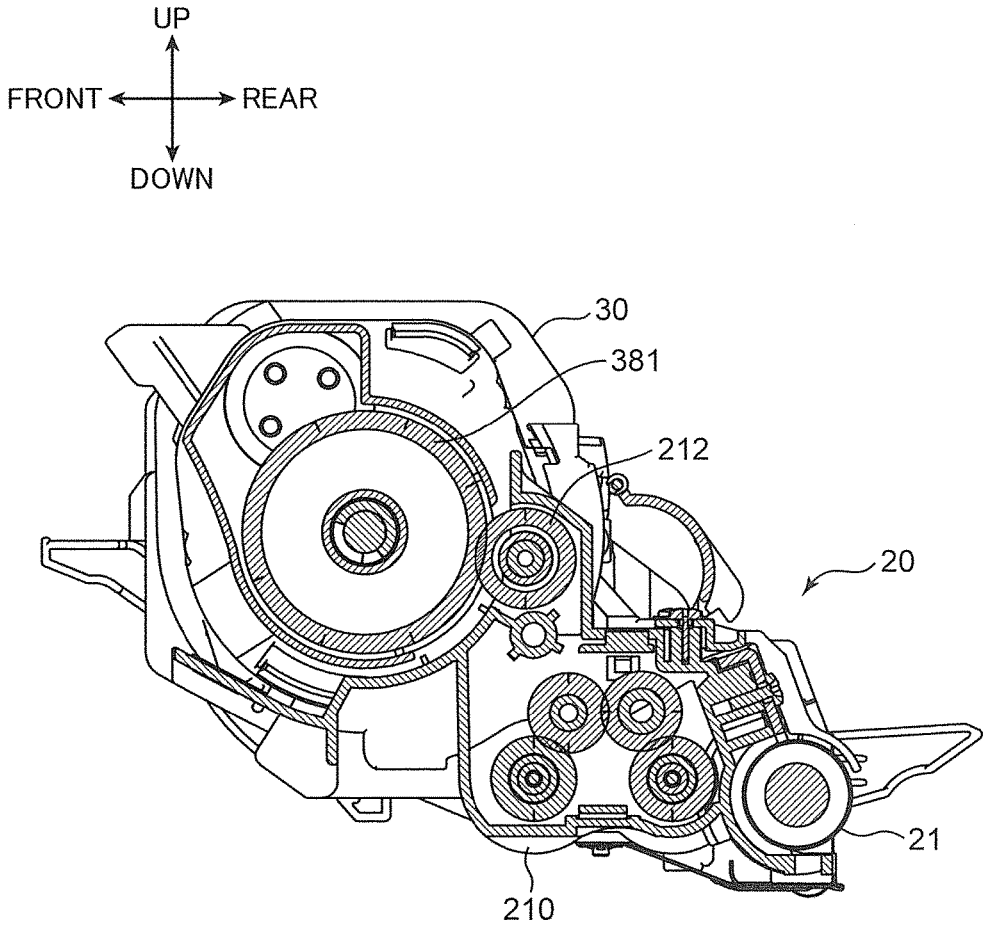
FIG. 32 is a sectional view of the developer storage container according to the embodiment of the present disclosure.
Figure 33:
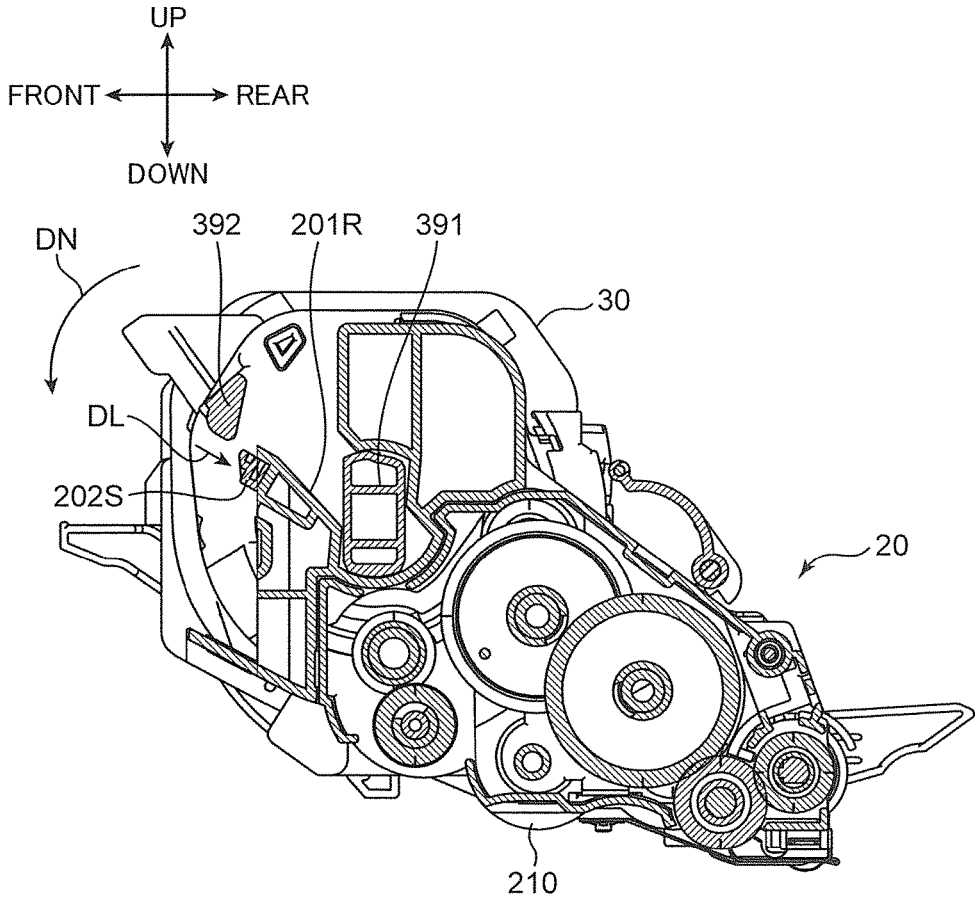
FIG. 33 is a sectional view of the developer storage container according to the embodiment of the present disclosure.
Figure 34:
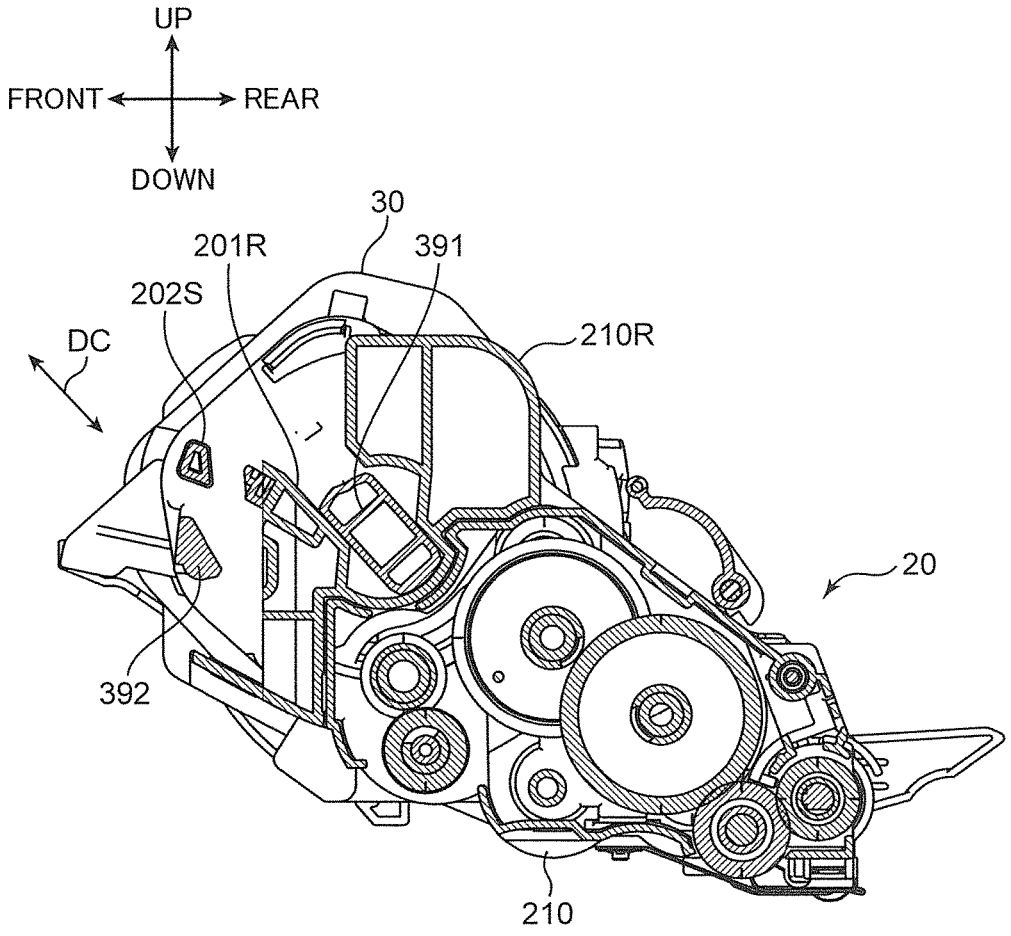
FIG. 34 is a sectional view of the developer storage container according to the embodiment of the present disclosure.
Figure 35:
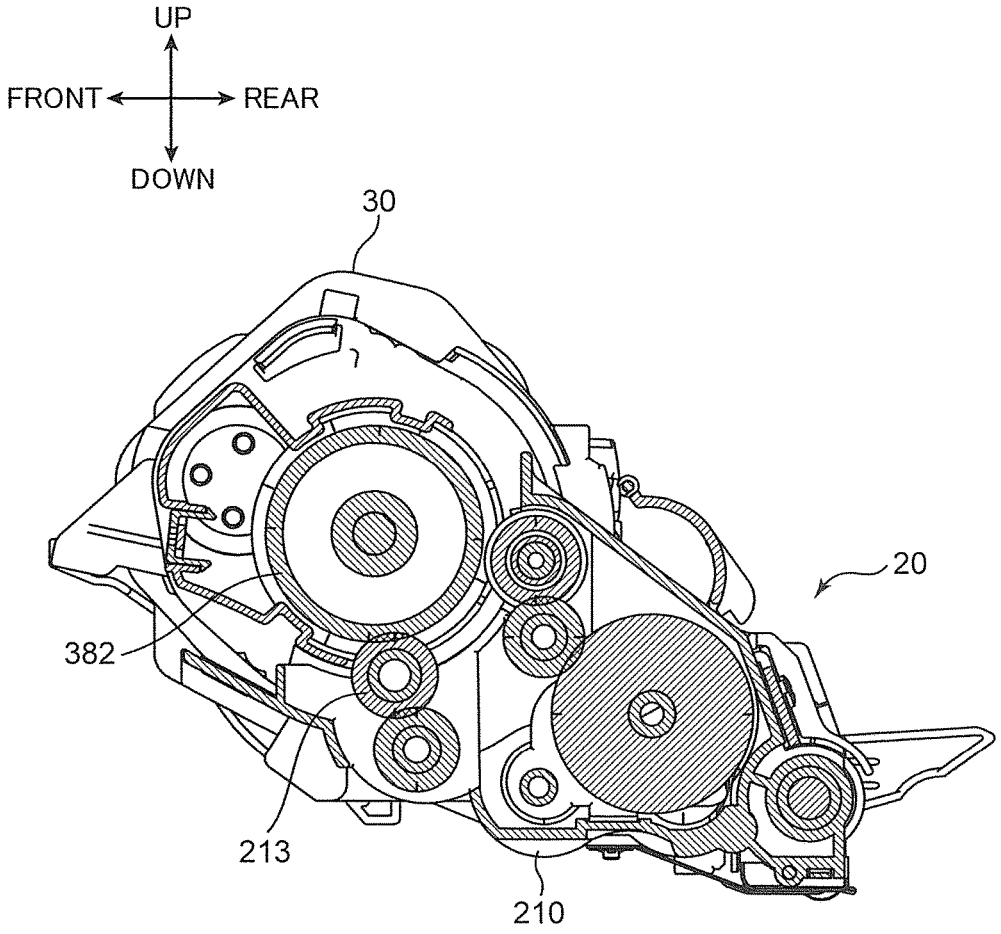
FIG. 35 is a sectional view of the developer storage container according to the embodiment of the present disclosure.
Figure 36:
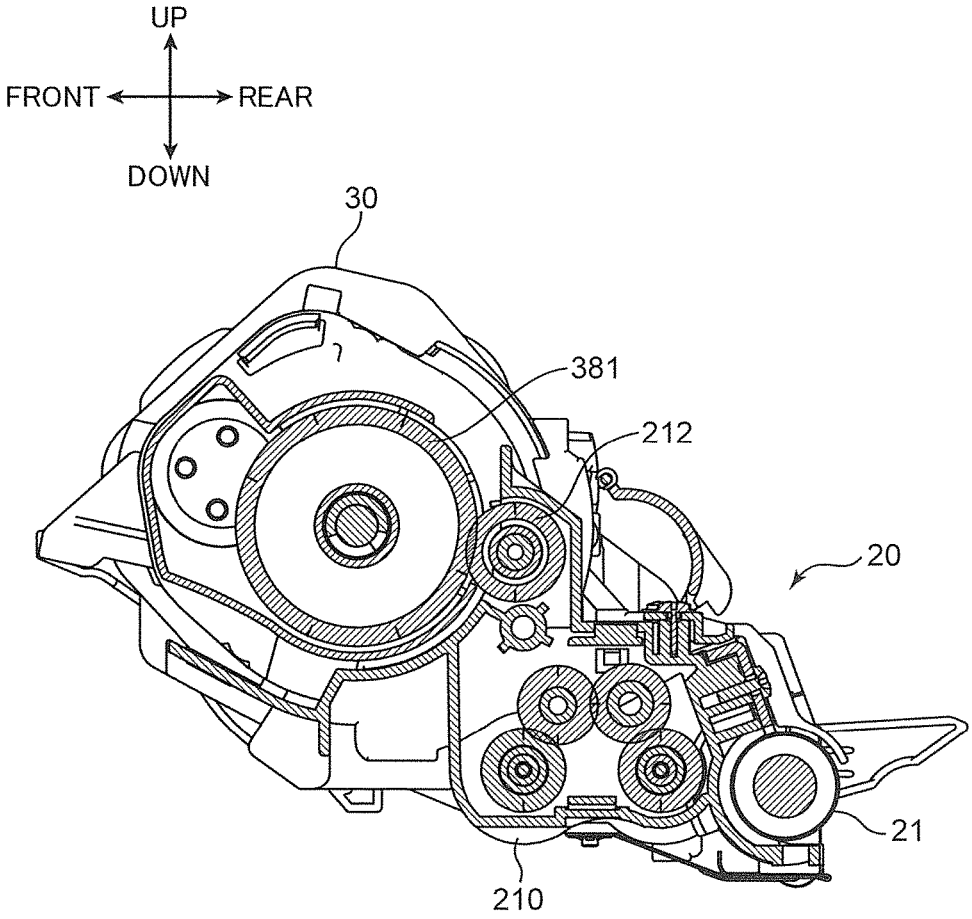
FIG. 36 is a sectional view of the developer storage container according to the embodiment of the present disclosure.

FIG. 29 is an enlarged plan view of the toner container 30 according to this embodiment. FIGS. 30 to 36 are sectional views of the toner container 30. Note that FIGS. 30, 33 and 34 show a cross-section including the front-rear direction and the vertical direction at a cross-sectional position A-A of FIG. 29 (cross-section passing through the second guide portion 391). Further, FIGS. 31 and 35 show a cross-section including the front-rear direction and the vertical direction at a cross-sectional position B-B of FIG. 29 (cross-section passing through the second container gear 382). Furthermore, FIGS. 32 and 36 show a cross-section including the front-rear direction and the vertical direction at a cross-sectional position C-C of FIG. 29 (cross-section passing through the first container gear 381).

Until the toner container 30 is attached to the developing device 20, the toner leaks out through the toner discharge port 377 if the container shutter 30S is erroneously moved from a position for closing the toner discharge port 377. In this embodiment, in a single state of the toner container 30, a sliding movement of the container shutter 30S from the toner discharge port 377 is prevented as described above. Thus, in storing or transporting the toner container 30 in the single state, the toner discharge port 377 is stably sealed by the container shutter 30S.

In exchanging the toner container 30, the toner container 30 is attached to the developing device 20 by the user of the printer 100 as described above. At this time, the user inserts the first and second guide portions 312, 391 of the toner container 30 into the left and right guide grooves 201L, 201R, whereby the toner container 30 is mounted at a first position in the container mounting portion 109 while being guided along the direction of the arrow DC of FIG. 7 by the left and right guide grooves 201L, 201R. Note that the posture of the toner container 30 at this time is defined as a first posture (FIGS. 34 to 36).

At this time, the unlocking projection 206 (FIG. 7) of the development housing 210 presses the unlocking portion 30S3 of the container shutter 30S of the toner container 30. As a result, the shutter locking portion 30S2 (FIG. 6) swings, thereby releasing the locking of the container shutter 30S by the shutter locking portion 30S2 to enable a sliding movement of the container shutter 30S.

On the other hand, when the toner container 30 is mounted in the first posture into the container mounting portion 109, parts of the container shutter 30S are engaged with the wedge-shaped notches of the pair of container shutter fixing portions 207 (FIG. 7). As a result, the container shutter 30S is fixed to the container shutter fixing portions 207. Thereafter, the container body 37 of the toner container 30 is rotated from the above first position in a first mounting rotating direction (direction of an arrow DM of FIG. 7) about an axis extending along the lateral direction by the user. At this time, the container body 37 reaches a second position while the toner discharge port 377 is relatively sliding with respect to the container shutter 30S. At this second position, the opened toner discharge port 377 communicates with the toner replenishing port 25 of the developing device 20. In other words, the toner discharge port 377 moves in the first mounting rotating direction together with the container body 37. As a result, the toner discharge port 377 comes out from the fixed container shutter 30S, and the opened toner discharge port 377 is located above the toner replenishing port 25 and can communicate with the toner replenishing port 25. Note that the posture of the toner container 30 at this time is defined as a second posture (FIGS. 30 to 32).

Further, in a state where the toner container 30 is not mounted in the container mounting portion 109, the housing shutter 210S (FIG. 7) seals the toner replenishing port 25. When the toner container 30 is mounted in the first posture into the container mounting portion 109, a part of the container body 37 of the toner container 30 is arranged to face the housing shutter 210S. When the toner container 30 is rotated in the first mounting rotating direction to change the posture from the first posture to the second posture as described above, the container body 37 presses the housing shutter 210S in the first mounting rotating direction against biasing forces of the pair of shutter springs 208. As a result, the housing shutter 210S slides in the first mounting rotating direction together with the container body 37 of the toner container 30 and the toner replenishing port 25 is opened as shown in FIG. 7. Thus, the toner discharge port 377 and the toner replenishing port 25 can communicate in the vertical direction.

FIGS. 30 to 32 show a state where the toner container 30 is mounted in the second posture at the second position in this way. At this time, the lock engaging piece 202S of the unlocking button 202 is engaged with the container engaging portion 392 of the toner container 30. Thus, erroneous rotation of the toner container 30 in a second mounting rotating direction (arrow DN of FIG. 33) opposite to the first mounting rotating direction is prevented. If the user presses the unlocking button 202 in the state of FIG. 30, the lock engaging piece 202S is disengaged from the container engaging portion 392 (arrow DL of FIG. 33). As a result, a force for restricting the rotation of the toner container 30 is lost. Thus, the container body 37 of the toner container 30 is rotated in the second mounting rotating direction (arrow DN of FIG. 33) by the biasing forces of the pair of shutter springs 208 (FIG. 7). At this time, by the pair of shutter springs 208, the housing shutter 210S is moved to a position where the toner replenishing port 25 is sealed. Further, the container body 37 is rotated in the second mounting rotating direction (direction of the arrow DN of FIG. 33) while the housing shutter 210S is engaged with a part of the container body 37.

As a result, the toner container 30 is arranged in the first posture at the first position again (FIGS. 34, 35 and 36). At this time, the second guide portion 391 is arranged to extend along a longitudinal direction of the right guide groove 201R. Note that the first guide portion 312 of the toner container 30 is also similarly arranged to extend in a longitudinal direction of the left guide groove 201L. Specifically, the toner container 30 can be separated along the mounting direction DC from the container mounting portion 109 (FIG. 7). Note that the second container gear 382 of the toner container 30 is engaged with the third transmission gear 213 of the developing device 20 (FIG. 35) and the first container gear 381 of the toner container 30 is engaged with the second transmission gear 212 of the developing device 20 (FIG. 36) until the toner container 30 reaches the first position from the second position.

Here in this embodiment, the second mounting rotating direction (arrow DN of FIG. 33) in which the container body 37 of the toner container 30 rotates by the unlocking button 202 being pressed in detaching the toner container 30 is the same as the direction (arrow DG1 of FIG. 7) in which the ratchet mechanism of the toner container 30 transmits a rotational drive force to the shaft 33. In other words, when the unlocking button 202 is pressed and the container body 37 rotates in the second mounting rotating direction by receiving the biasing forces of the pair of shutter springs 208, the second container gear 382 engaged with the third transmission gear 213 of the developing device 20 relatively rotates in the direction of the arrow DG2 of FIG. 28 with respect to the container body 37. At this time, the second container gear 382 and the shaft 33 are uncoupled by the action of the aforementioned ratchet mechanism. Thus, a moving load of the moving wall 32 is not applied to a rotating operation of the toner container 30 and a rotational movement of the toner container 30 to the first position is stably realized.

As described above, according to this embodiment, when the shaft 33 is rotated in the first rotating direction (arrow R1 of FIG. 19), the pressing member 34 presses the moving wall 32 to move the moving wall 32 in the first direction (arrow DA of FIGS. 9 and 22), whereby the toner in the storage space 37S can be discharged through the toner discharge port 377. Further, when the shaft 33 is rotated in the second rotating direction (arrow R2 of FIG. 20), the pressing member 34 moves to the upstream side in the first direction (arrow DB of FIGS. 21 and 22), leaving the moving wall 32. Thus, a large change of a toner distributed state on a side downstream of the moving wall 32 in the first direction is suppressed and the discharge of the toner is stably maintained. Thus, even if an operator directly rotates the shaft 33 after removing the ratchet mechanism of the toner container 30 during the maintenance of the toner container 30, a movement of the moving wall 32 to the upstream side in the first direction is prevented. As a result, the position of the moving wall 32 in the first direction is reproduced and a distribution of the toner in the storage space 37S is stably kept when the toner container 30 is mounted into the printer 100 again. Thus, the same pressing force as that in the state before the toner container 30 is detached is applied to the toner around the toner replenishing port 25 and the toner discharge port 377 and toner replenishment from the toner container 30 to the developing device 20 is stably maintained. Note that these functions and effects are similarly exhibited also for the aforementioned function of the ratchet mechanism to prevent a movement of the moving wall 32 to the upstream side in the first direction.

Further, in this embodiment, the outer peripheral surface of the pressing member 34 is arranged radially inward of and at a distance from the inner peripheral surface 37K of the container body 37. Thus, the pressing member 34 is set to be compact and a load applied to the shaft 33 is reduced as compared to the case where the pressing member 34 slides in contact with the inner peripheral surface 37K of the container body 37.

Further, in this embodiment, the pressing surface 34F of the pressing member 34 presses the pressed portion 323J1 of the moving wall 32 in the first direction in the entire circumferential direction of the shaft 33. Thus, the moving wall 32 receives a pressing force from the pressing member 34 in the entire circumferential direction about the shaft 33. As a result, the inclination of the conveying surface 320S of the moving wall 32 with respect to the shaft 33 is suppressed.

Further, in this embodiment, the hollow cylindrical portion 323J of the moving wall 32 is housed into the hollow cylindrical pressing member 34. The pressing member 34 presses the pressed portion 323J1 formed on the tip part of the hollow cylindrical portion 323J. Thus, a pressing force is stably applied from the pressing member 34 to the moving wall 32. In other words, a contact area of the pressing member 34 and the moving wall 32 is stably kept as compared to the case where the tip part of the hollow cylindrical pressing member 34 presses the tip part of the hollow cylindrical portion 323J of the moving wall 32.

Further, in this embodiment, the pressing member 34 includes the pressing member engaging portion 34K radially projecting and having the circumferentially extending tip part. Further, the moving wall 32 is formed with the insertion hole H allowing the engagement of the tip part of the pressing member engaging portion 34K along the circumferential direction. When the shaft 33 is rotated in the first rotating direction, the tip part of the pressing member engaging portion 34K is engaged with the insertion hole H and the pressing surface 34F presses the pressed portion 323J1 of the moving wall 32 according to the engagement of the externally threaded portion 333 and the internally threaded portion 34J, whereby the pressing member 34 moves in the first direction integrally with the moving wall 32. Thus, movements of both the moving wall 32 and the pressing member 34 are stably maintained. Further, even if the toner container 30 is held in such a posture that the shaft 33 vertically extends, it is suppressed that the pressing member 34 is separated from the moving wall 32 and falls along the shaft 33. Further, when the shaft 33 is rotated in the second rotating direction, the pressing member engaging portion 34K of the pressing member 34 and the insertion hole H of the moving wall 32 are disengaged and the pressing surface 34F is arranged upstream of and at a distance from the pressed portion 323J1 of the moving wall 32 in the first direction. Thus, the moving wall 32 is prevented from erroneously moving to the upstream side in the first direction together with the pressing member 34.

Further, in this embodiment, the externally threaded portion 333 includes the first male slope 333A and the second male slope 333B and the internally threaded portion 34J includes the first female slope 34J1 and the second female slope 34J2 as shown in FIG. 22. Thus, a rotational torque applied to the shaft 33 in the case of rotating the shaft 33 in the second rotating direction can be made larger. Therefore, even if the shaft 33 is rotated in the second rotating direction, the pressing member 34 is prevented from being largely separated from the moving wall 32.

Further, in this embodiment, the volume replenishment type developing device 20 is adopted, and the toner is replenished into the developing device 20 from the toner container 30 by the toner in the storage space 37S applying a pressure to the toner around the toner discharge port 377 and the toner replenishing port 25. Since the toner distributed state in the storage space 37S is not largely changed by the action of the moving wall 32 and the pressing member 34, the toner is stably replenished into the development housing 210 of the developing device 20.

Further, in this embodiment, when the second container gear 382 is rotated in the first rotating direction, the aforementioned ratchet mechanism couples the second container gear 382 and the shaft 33 and rotates the shaft 33 in the first rotating direction, thereby allowing the moving wall 32 to move in the first direction. Further, when the second container gear 382 is rotated in the second rotating direction, the ratchet mechanism uncouples the second container gear 382 and the shaft 33 and restricts the rotation of the shaft 33 in the first rotating direction, thereby restricting movements of the moving wall 32 in the first direction and a direction opposite to the first direction. Thus, when the second container gear 382 is rotated in the first rotating direction, the moving wall 32 moves in the first direction, whereby the toner in the storage space 37S can be discharged through the toner discharge port 377. Further, even if the second container gear 382 is rotated in the second rotating direction, a large change of a toner distributed state on a side downstream of the moving wall 32 in the first direction is suppressed and the discharge of the toner is stably maintained. As a result, an image can be stably formed on a sheet.

Also in this embodiment, the rotation of the shaft 33 in the first rotating direction can be allowed and the rotation thereof in the second rotating direction can be restricted by the ratchet mechanism including the hollow cylindrical portion 382S of the second container gear 382, the ratchet gear 383 and the ratchet shaft 384. As a result, a movement of the moving wall 32 in the first direction is allowed and a movement thereof in the direction opposite to the first direction is restricted. Particularly, when the second container gear 382 is rotated in the first rotating direction, the hollow cylindrical portion 382S, the ratchet gear 383 and the ratchet shaft 384 integrally rotate in the first rotating direction, whereby the shaft 33 is rotated in the first rotating direction. Further, when the second container gear 382 is rotated in the second rotating direction, at least one of the coupling of the hollow cylindrical portion 382S and the ratchet gear 383 and the coupling of the ratchet gear 383 and the ratchet shaft 384 is released, whereby the rotation of the shaft 33 in the second rotating direction is restricted.

Also in this embodiment, the shapes of the right and left guide grooves 201R, 201L are set such that the toner container 30 is held in the second posture by the lock engaging piece 202S while the toner discharge port 377 is relatively sliding with respect to the container shutter 30S and the toner discharge port 377 opened from the container shutter 30S is allowed to communicate with the toner replenishing port 25 when the toner container 30 is mounted in the first posture into the container mounting portion 109 while being guided along the predetermined mounting direction DC by the right and left guide grooves 201R, 201L, the container shutter 30S is fixed to the container shutter fixing portions 207 and the container body 37 is rotated in the first mounting rotating direction (DM) about the axis extending in the first direction. Further, when the unlocking button 202 is pressed with the toner container 30 set in the second posture, the lock engaging piece 202S and the toner container 30 are disengaged and the posture of the toner container 30 is changed from the second posture to the first posture while being rotated in the second mounting rotating direction (DN) opposite to the first mounting rotating direction by biasing forces of the shutter springs 208. The ratchet mechanism (restricting mechanism) of the toner container 30 allows the second container gear 382 to relatively rotate in the second rotating direction with respect to the container body 37 by being engaged with the third transmission gear 213 when the container body 37 of the toner container 30 is rotated in the second mounting rotating direction by the biasing forces of the shutter springs 208. As a result, it is suppressed that a large load is applied to the rotation of the toner container 30 by the engagement of the second container gear 382 and the third transmission gear 213 when the unlocking button 202 is pressed and the posture of the toner container 30 is changed from the second posture to the first posture. At this time, since the second container gear 382 and the shaft 33 are uncoupled, it is suppressed that a moving load of the moving wall 32 is applied to the rotation of the toner container 30.

The printer 100 with the toner container 30 according to this embodiment of the present disclosure has been described above. According to this configuration, the toner container 30 and the printer 100 provided with the same are provided in which a large change of the toner distributed state in the storage space 37S due to a backward movement of the moving wall 32 is suppressed. On the other hand, the present disclosure is not limited to this and, for example, the following modifications can be adopted.

(1) Although a monochrome printer is described as the printer 100 in the above embodiment, the present disclosure is not limited to this. Particularly, if the printer 100 is a tandem color printer, respective toner containers 30 may be mounted from above into the housing 101 to be adjacent to each other in correspondence with a plurality of colors of toners after the access cover 100C (FIG. 2) of the printer 100 is opened.

(2) Further, although the moving wall 32 moves from the side of the lid portion 31 to the side of the right wall 375 in the above embodiment, the present disclosure is not limited to this. The toner discharge port 377 may be open on the side of the lid portion 31 and the moving wall 32 may move from the side of the right wall 375 to the side of the lid portion 31. Further, the opening position of the toner discharge port 377 is not limited to the above position. The toner discharge port 377 may be open in a lowermost surface part of the container body 37 or may be open at another position.

(3) Further, although the volume replenishment type toner replenishing method is described in the above embodiment, the present disclosure is not limited to this. An unillustrated toner sensor may be provided also in the development housing 210 of the developing device 20 and the moving wall 32 may be moved to replenish the toner from the toner container 30 into the developing device 20 according to an output of this toner sensor. Further, the developing method of the developing device 20 is not limited to the one-component developing method, and a two-component developing method may be adopted.

(4) Further, although the studs 321B and the engaging pieces 321C project from the wall plate 321 of the moving wall 32 in the above embodiment, the studs 321B and the engaging pieces 321C may project from the side of the wall body portion 323 toward the wall plate 321. Further, the numbers and positions of the studs 321B and the engaging pieces 321C are not limited to the above ones. Further, the seal pressing ribs 323F configured to come into contact with the seal member 322 may be arranged on the side of the wall plate 321 or may be arranged on both the wall plate 321 and the wall body portion 323. Further, the number and shape of the seal pressing ribs 323F are not limited to the above ones. The seal pressing ribs 323F are not limited to those continuously extending along the circumferential direction of the shaft 33 and may be arranged at predetermined intervals.

Figure 37:
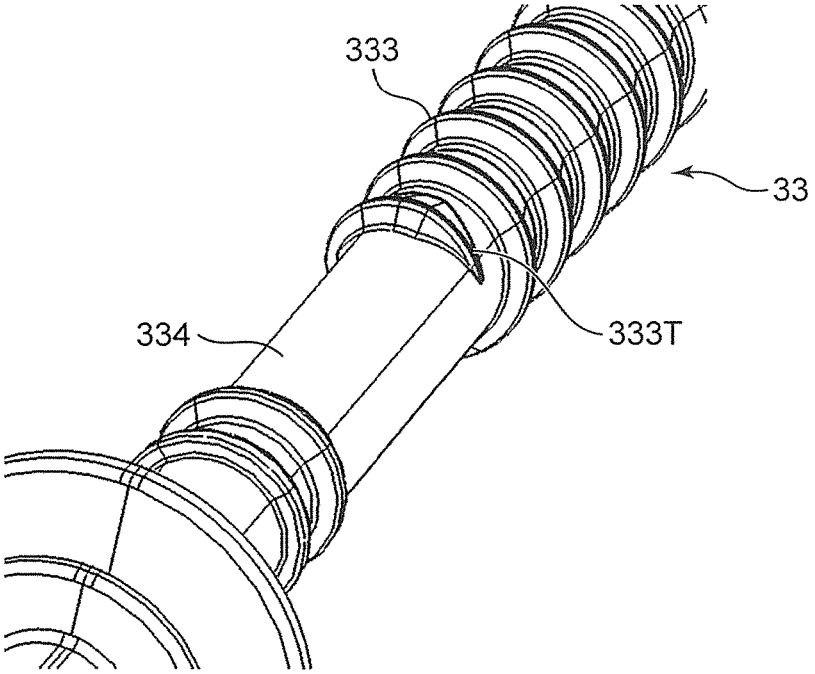
FIG. 37 is a perspective view of a shaft portion of a developer storage container according to a modification of the present disclosure.
Figure 38:
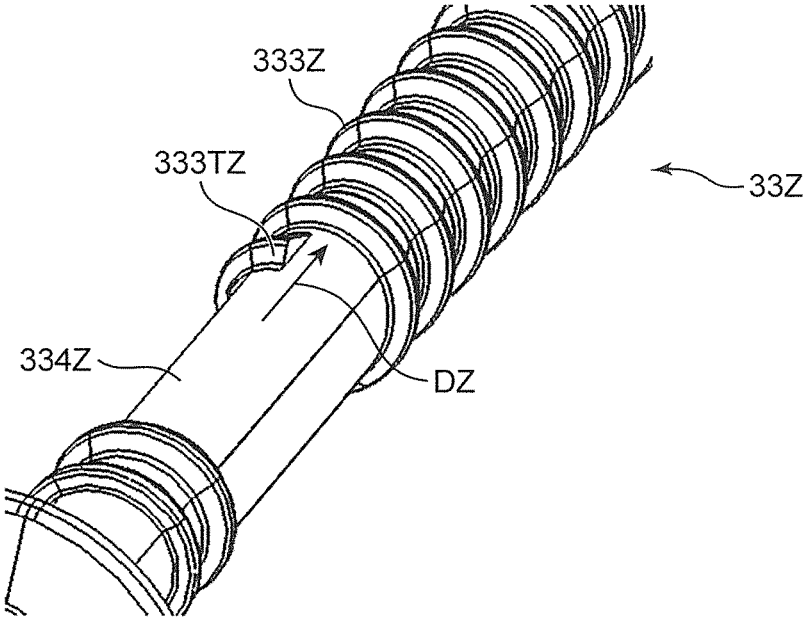
FIG. 38 is a perspective view of a shaft portion of another developer storage container to be compared with the developer storage container according to the modification of the present disclosure.

(5) FIG. 37 is a perspective view of a shaft 333 of a toner container (developer storage container) according to a modification of the present disclosure. Further, FIG. 38 is a perspective view of a shaft 33Z of another toner container to be compared with the toner container according to this modification. In the shaft 33 shown in FIG. 37, a tip part 333T is arranged on an end part of an externally threaded portion 333 closest to a moving wall stopping portion 334. The tip part 333T is smoothly coupled to a shaft portion of the shaft 33 to gradually reduce an outer diameter of the spiral outer peripheral edge of the externally threaded portion 333. On the other hand, on the shaft 33Z shown in FIG. 38, a tip part 333TZ is arranged on an end part of an externally threaded portion 333Z closest to a moving wall stopping portion 334Z. The tip part 333TZ has a side surface discontinuous with the outer peripheral surface of the shaft 33Z. In other words, the tip part 333TZ is shaped by cutting the externally threaded portion 333Z at a predetermined circumferential position. When the shaft 33Z is inserted into the seal shaft hole 322H (FIG. 13) of the seal member 322 of the moving wall 32, the seal shaft hole 322H is held in close contact with the shaft 33Z along a circumferential direction. However, a substantially triangular clearance is easily formed in a contact part of the shaft 33Z and the seal shaft hole 322H at the tip part 333TZ. As a result, as shown by an arrow DZ of FIG. 38, the toner in the storage space 37S (FIG. 9) possibly enters the inside of the seal shaft hole 322H. On the other hand, on the shaft 333 shown in FIG. 37, the tip part 333T is smoothly inclined along the circumferential direction. Thus, a clearance is less likely to be formed in a contact part of the shaft 333 and the seal shaft hole 322H at the tip part 333T. As a result, the entrance of the toner into the inside of the seal shaft hole 322H is prevented. Note that a mode of FIG. 38 is not excluded from the configuration of the present disclosure.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developer storage container, comprising:

a container body having an inner peripheral surface defining a tubular internal space extending along a first direction, the container body being formed with a developer discharge port open to communicate with the internal space and allowing a developer to be discharged;

a shaft arranged to extend in the first direction in the internal space and rotatably supported in the container body, the shaft including a first engaging portion spirally formed along the first direction on an outer peripheral surface;

a moving wall including a first bearing portion, the shaft being inserted through the first bearing portion, an outer peripheral surface arranged in contact with the inner peripheral surface of the container body and a conveying surface defining a storage space for storing the developer together with the inner peripheral surface of the container body, the moving wall being movable in the first direction along the shaft in the internal space while conveying the developer in the internal space toward the developer discharge port; and a pressing member arranged upstream of the moving wall in the first direction, the pressing member including a second bearing portion, the shaft being inserted through the second bearing portion, a second engaging portion arranged on an inner peripheral surface of the second bearing portion and engageable with the first engaging portion, and a pressing portion configured to press the moving wall in the first direction, the pressing member being configured to move in the first direction integrally with the moving wall by the pressing portion pressing the moving wall according to the engagement of the first engaging portion and the second engaging portion when the shaft is rotated in a first rotating direction, and the pressing member moving to an upstream side in the first direction with respect to the moving wall and thereby leaving the moving wall according to the engagement of the first engaging portion and the second engaging portion when the shaft is rotated in a second rotating direction opposite to the first rotating direction.

2. A developer storage container according to claim 1, wherein:

an outer peripheral surface of the pressing member is arranged radially inward of and at a distance from the inner peripheral surface of the container body.

3. A developer storage container according to claim 1, wherein:

the pressing portion of the pressing member presses the moving wall in the first direction in an entire circumferential direction about the shaft.

4. An image forming apparatus, comprising:

a developer storage container according to claim 1;

an image carrier configured such that an electrostatic latent image is formed on a surface and a developer image is carried thereon;

a developing device configured to have the developer replenished thereinto from the developer storage container and supply the developer to the image carrier; and a transfer unit configured to transfer the developer image from the image carrier to a sheet.

5. An image forming apparatus according to claim 4, wherein the developing device includes:

a housing having a developer conveyance path configured such that the developer is conveyed in a predetermined conveying direction therein;

a developer replenishing port open in the housing below the developer discharge port and configured to receive the developer from the developer storage container into the developer conveyance path;

a developer conveying member arranged in the developer conveyance path and configured to convey the developer in the conveying direction; and a conveying ability suppressing portion configured to partially suppress a conveying ability of the developer conveying member to convey the developer in the conveying direction on a side downstream of the developer replenishing port in the conveying direction.

6. A developer storage container, comprising:

a container body having an inner peripheral surface defining a tubular internal space extending along a first direction, the container body being formed with a developer discharge port open to communicate with the internal space and allowing a developer to be discharged;

a shaft arranged to extend in the first direction in the internal space and rotatably supported in the container body, the shaft including a first engaging portion spirally formed along the first direction on an outer peripheral surface;

a moving wall including a first bearing portion, the shaft being inserted through the first bearing portion, an outer peripheral surface arranged in contact with the inner peripheral surface of the container body and a conveying surface defining a storage space for storing the developer together with the inner peripheral surface of the container body, the moving wall being movable in the first direction along the shaft in the internal space while conveying the developer in the internal space toward the developer discharge port; and a pressing member arranged upstream of the moving wall in the first direction, the pressing member including a second bearing portion, the shaft being inserted through the second bearing portion, a second engaging portion arranged on an inner peripheral surface of the second bearing portion and engageable with the first engaging portion, and a pressing portion configured to press the moving wall in the first direction, the pressing member being configured to move in the first direction integrally with the moving wall by the pressing portion pressing the moving wall according to the engagement of the first engaging portion and the second engaging portion when the shaft is rotated in a first rotating direction and relatively move to an upstream side in the first direction with respect to the moving wall according to the engagement of the first engaging portion and the second engaging portion when the shaft is rotated in a second rotating direction opposite to the first rotating direction, wherein:

the pressing portion of the pressing member presses the moving wall in the first direction in an entire circumferential direction about the shaft the pressing member has a hollow cylindrical shape to enclose the shaft;

the pressing portion is formed into a ring shape inside the pressing member;

the moving wall includes a wall body portion and a wall hollow cylindrical portion projecting toward the upstream side in the first direction from the wall body portion and to be inserted into a hollow cylindrical interior of the pressing member; and a pressed portion configured to contact the pressing portion in the entire circumferential direction is formed on a tip part of the wall hollow cylindrical portion on the upstream side in the first direction.

7. A developer storage container according to claim 6, wherein:

the pressing member includes a pressing member engaging portion radially projecting and having a tip part extending in the circumferential direction;

the moving wall is formed with an engaged portion configured to allow the engagement of the tip part of the pressing member engaging portion along the circumferential direction; and when the shaft is rotated in the first rotating direction, the tip part of the pressing member engaging portion is engaged with the engaged portion and the pressing portion presses the pressed portion of the moving wall according to the engagement of the first engaging portion and the second engaging portion, whereby the pressing member moves in the first direction integrally with the moving wall.

8. A developer storage container according to claim 7, wherein:

when the shaft is rotated in the second rotating direction, the pressing member relatively moves to the upstream side in the first direction with respect to the moving wall according to the engagement of the first engaging portion and the second engaging portion, the tip part of the pressing member engaging portion is disengaged from the engaged portion, and the pressing portion is arranged upstream of and at a distance from the pressed portion of the moving wall in the first direction.

9. A developer storage container, comprising:

a container body having an inner peripheral surface defining a tubular internal space extending along a first direction, the container body being formed with a developer discharge port open to communicate with the internal space and allowing a developer to be discharged;

a shaft arranged to extend in the first direction in the internal space and rotatably supported in the container body, the shaft including a first engaging portion spirally formed along the first direction on an outer peripheral surface;

a moving wall including a first bearing portion, the shaft being inserted through the first bearing portion, an outer peripheral surface arranged in contact with the inner peripheral surface of the container body and a conveying surface defining a storage space for storing the developer together with the inner peripheral surface of the container body, the moving wall being movable in the first direction along the shaft in the internal space while conveying the developer in the internal space toward the developer discharge port; and a pressing member arranged upstream of the moving wall in the first direction, the pressing member including a second bearing portion, the shaft being inserted through the second bearing portion, a second engaging portion arranged on an inner peripheral surface of the second bearing portion and engageable with the first engaging portion, and a pressing portion configured to press the moving wall in the first direction, the pressing member being configured to move in the first direction integrally with the moving wall by the pressing portion pressing the moving wall according to the engagement of the first engaging portion and the second engaging portion when the shaft is rotated in a first rotating direction and relatively move to an upstream side in the first direction with respect to the moving wall according to the engagement of the first engaging portion and the second engaging portion when the shaft is rotated in a second rotating direction opposite to the first rotating direction, wherein:

the first engaging portion includes:

a first inclined surface inclined to extend radially inward along the first direction; and a second inclined surface arranged on a side opposite to the first inclined surface across a ridge of the first engaging portion, inclined to extend radially outward along the first direction, and more gently inclined than the first inclined surface;

the second engaging portion is a spiral projection and includes:

a third inclined surface inclined to extend radially inward along the first direction; and a fourth inclined surface arranged on a side opposite to the third inclined surface across a ridge of the second engaging portion, inclined to extend radially outward along the first direction, and more gently inclined than the third inclined surface; and a rotational torque applied to the shaft according to the engagement of the second inclined surface of the first engaging portion and the fourth inclined surface of the second engaging portion when the shaft is rotated in the second rotating direction is larger than a rotational torque applied to the shaft according to the engagement of the first inclined surface of the first engaging portion and the third inclined surface of the second engaging portion when the shaft is rotated in the first rotating direction.

* * * * *